US008425255B2

(12) United States Patent
Erickson et al.

(10) Patent No.: US 8,425,255 B2
(45) Date of Patent: Apr. 23, 2013

(54) SPRING ASSEMBLY WITH SPRING MEMBERS BIASING AND CAPACITIVELY COUPLING JACK CONTACTS

(75) Inventors: Jason Erickson, Mill Creek, WA (US); Hua Wang, Mill Creek, WA (US); Adam Bily, Bothell, WA (US)

(73) Assignee: Leviton Manufacturing Co., Inc., Melville, NY (US)

( * ) Notice: Subject to any disclaimer, the term of this patent is extended or adjusted under 35 U.S.C. 154(b) by 160 days.

(21) Appl. No.: 13/021,628

(22) Filed: Feb. 4, 2011

(65) Prior Publication Data

US 2012/0202389 A1 Aug. 9, 2012

(51) Int. Cl.
*H01R 13/66* (2006.01)

(52) U.S. Cl.
USPC ..... 439/620.22; 439/676

(58) Field of Classification Search ..... 439/676, 439/620.22
See application file for complete search history.

(56) References Cited

U.S. PATENT DOCUMENTS

| | | | | |
|---|---|---|---|---|
| 6,089,923 | A | 7/2000 | Phommachanh | |
| 6,332,810 | B1 | 12/2001 | Bareel | |
| 6,530,810 | B2 | 3/2003 | Goodrich et al. | |
| 6,579,128 | B1 | 6/2003 | Wu | |
| 6,641,443 | B1 | 11/2003 | Itano et al. | |
| 6,786,776 | B2 | 9/2004 | Itano et al. | |
| 7,037,140 | B2 | 5/2006 | Aekins et al. | |
| 7,038,554 | B2 | 5/2006 | Seefried | |
| 7,140,924 | B2 | 11/2006 | Redfield et al. | |
| 7,601,034 | B1 | 10/2009 | Aekins et al. | |
| 7,682,203 | B1 | 3/2010 | Pharney et al. | |
| RE41,250 | E | 4/2010 | Henneberger | |
| 7,736,195 | B1 | 6/2010 | Poulsen et al. | |
| 7,824,231 | B2 | 11/2010 | Marti et al. | |
| 7,857,667 | B1 * | 12/2010 | Wang | 439/676 |
| 7,967,645 | B2 * | 6/2011 | Marti et al. | 439/676 |
| 2008/0090468 | A1 | 4/2008 | Reeves et al. | |
| 2009/0029599 | A1 | 1/2009 | Jaouen | |
| 2010/0041274 | A1 * | 2/2010 | Marti et al. | 439/607.01 |
| 2010/0041278 | A1 * | 2/2010 | Bopp et al. | 439/676 |
| 2010/0062644 | A1 * | 3/2010 | Aekins et al. | 439/620.21 |
| 2010/0317230 | A1 * | 12/2010 | Larsen et al. | 439/620.22 |
| 2011/0104933 | A1 * | 5/2011 | Straka et al. | 439/404 |

OTHER PUBLICATIONS

International Search Report, PCT/US2012/022892, filed Jan. 27, 2012, mailed Sep. 27, 2012.

* cited by examiner

*Primary Examiner* — Truc Nguyen
(74) *Attorney, Agent, or Firm* — Davis Wright Tremaine LLP; George C. Rondeau, Jr.; Heather M. Colburn

(57) ABSTRACT

A spring assembly for a communications jack including a plurality of jack contacts each electrically connectable to a corresponding plug contact of a communications plug. First and second jack contacts carry a first differential signal. Fifth and sixth jack contacts carry a second differential signal. The jack contacts carrying the first differential signal are adjacent a third jack contract and the jack contacts carrying the second differential signal are adjacent a fourth jack contract. For each jack contact, the assembly has a conductive spring member electrically connected to the jack contact that biases the jack contact against a corresponding plug contact. To reduce crosstalk, the spring members connected to the first and second jack contacts are each capacitively coupled to the fourth jack contact, and the spring members connected to the fifth and sixth jack contacts are each capacitively coupled to the third jack contact.

33 Claims, 17 Drawing Sheets

SPRING ASSEMBLY WITH SPRING MEMBERS BIASING AND CAPACITIVELY COUPLING JACK CONTACTS

BACKGROUND OF THE INVENTION

1. Field of the Invention

The present invention is directed generally to communication jacks.

2. Description of the Related Art

Communication jacks incorporating Retention Force Technology ("RFT") are commercially available from Leviton Manufacturing Co., Inc. and described in U.S. Pat. Nos. 6,786,776 and 6,641,443, which are incorporated by reference herein in their entireties. For illustrative purposes, FIGS. 4 and 2 of these patents have been reproduced herein as FIGS. 1 and 2, respectively.

Turning to FIG. 1, the aforementioned patents describe an electrical connector jack 10 that includes a dielectric housing or body 12 and a plurality of resilient contact tines 14 (see FIG. 2) arranged in a parallel arrangement within an interior receptacle 16 of the body. When a conventional plug 18 having a plurality of metal conductive plates or contacts 20 is inserted into the receptacle 16, the contacts 20 are in contact with corresponding ones of the tines 14. The tines 14 each have a first end portion 22 fixedly attached to a printed circuit board ("PCB") 24, and a second free end portion 26 opposite the first end portion 22. Between the first and second end portions 22 and 26, the tines each include a first contact portion 28 and a second contact portion 47. The first contact portions 28 are arranged in the body 12 to be contacted by the contacts 20 of the plug 18 when the plug is inserted into the receptacle 16. The second contact portions 47 are located between the first contact portions 28 and the first end portions 22.

When the plug contacts 20 contact the first contact portions 28 of the tines 14, the contacted tines are moved by the plug contacts 20 in a generally downward direction, with a small rearward component, as the tines flex downward in response thereto. Each of the tines 14 is sufficiently resilient to produce a first generally upward force against the corresponding plug contact 20 in response thereto. This serves as a contact force between the tine 14 and the plug contact 20 to help provide good electrical contact.

A spring assembly 32 is mounted to the PCB 24 in a position below the tines 14. As best seen in FIG. 2, the spring assembly 32 has a pair of protrusions 34 that are inserted into apertures in the PCB 24. The spring assembly 32 includes eight resilient, non-conductive spring arms 44, each positioned immediately under a correspondingly positioned one of the tines 14. Turning to FIG. 1, a head portion 45 of each spring arm 44 is in contact with an underside of the second contact portion 47 of the tine, the underside being opposite the side of the tine contacted by the plug contact 20. Each of the spring arms 44 is positioned to have the head portion 45 thereof engaged by and move downward with the correspondingly positioned tine 14 as the tine moves downward when the plug 18 is inserted into the receptacle 16.

Each of the spring arms 44 is independently movable relative to the other ones of the spring arms, and each spring arm provides a second generally upward force on the correspondingly positioned tine which is transmitted to the plug contact 20 contacting the tine. This creates a supplemental contact force that causes an increased contact force between the tine 14 and the plug contact 20. For the sake of brevity, the benefits of the structures of the jack 10 that are described in U.S. Pat. Nos. 6,786,776 and 6,641,443 are not repeated herein.

While not described in U.S. Pat. Nos. 6,786,776 and 6,641,443, referring to FIG. 3, the performance of the jack 10 may be improved by the addition of crosstalk compensation components. For example, in the drawings, the tines 14 include eight separate spaced apart contacts or tines J-T1 to J-T8 arranged in series. The center-most tines J-T3, J-T4, J-T5, and J-T6 may be connected to a flexible PCB 50 having crosstalk attenuating or cancelling circuits formed thereon configured to provide crosstalk compensation. The flexible PCB 50 may include contacts 52, 54, 56, and 58 configured to be soldered to the centermost tines J-T3, J-T4, J-T5, and J-T6, respectively.

In the embodiment illustrated in FIG. 3, the spring assembly 32 (see FIGS. 1 and 2) is implemented as a non-conductive plastic spring 60 constructed (e.g., molded) as a single piece instead of from two separate components (e.g., the first portion 46*a* and the second portion 46*b* described in U.S. Pat. Nos. 6,786,776 and 6,641,443). However, the spring 60 is configured to function in a manner substantially similar to that of the spring assembly 32 and to provide the supplemental contact forces to the tines 14 that causes an increased contact force between the tines 14 and the plug contacts 20. Thus, the current technology uses a non-conductive plastic spring (e.g., the spring assembly 32 or the spring 60) to help generate sufficient contact force between the tines 14 and the plug contacts 20 (see FIG. 1) and a flexible PCB (e.g., the flexible PCB 50) to provide electrical crosstalk compensation.

The jack 10 (see FIG. 1) may be assembled by first pressing the tines J-T1 to J-T8 into the PCB 24 at appropriate locations within the circuits located on the PCB 24. Then, crosstalk compensation is added to the jack 10 (see FIG. 1), by soldering the contacts 52, 54, 56, and 58 of the flexible PCB 50 to second free end portions 26 of the center-most tines J-T3, J-T4, J-T5, and J-T6. Next, the soldered connections are washed to remove excess solder material (not shown), including flux. The non-conductive plastic spring 60 or the spring assembly 32 is connected to the PCB 24 below the tines J-T1 to J-T8 to provide the supplemental contact forces thereto. The tines J-T1 to J-T8 (and the non-conductive plastic spring 60 or the spring assembly 32) connected to the PCB 24 are inserted into the body 12 (see FIG. 1) and extend forwardly into the receptacle 16. Then, the PCB 24 is affixed to the body 12.

A need exists for jacks that provide both adequate contact force between the tines and the plug contacts and electrical crosstalk compensation. Improvements in manufacturability of jacks may reduce their cost of assembly and a reduction in the number of components may improve reliability of the jacks. Therefore, a jack that includes fewer components than prior art jacks and is easier to assemble than prior art jacks is desirable. The present application provides these and other advantages as will be apparent from the following detailed description and accompanying figures.

BRIEF DESCRIPTION OF THE SEVERAL VIEWS OF THE DRAWING(S)

DETAILED DESCRIPTION OF THE INVENTION

Figure 2:
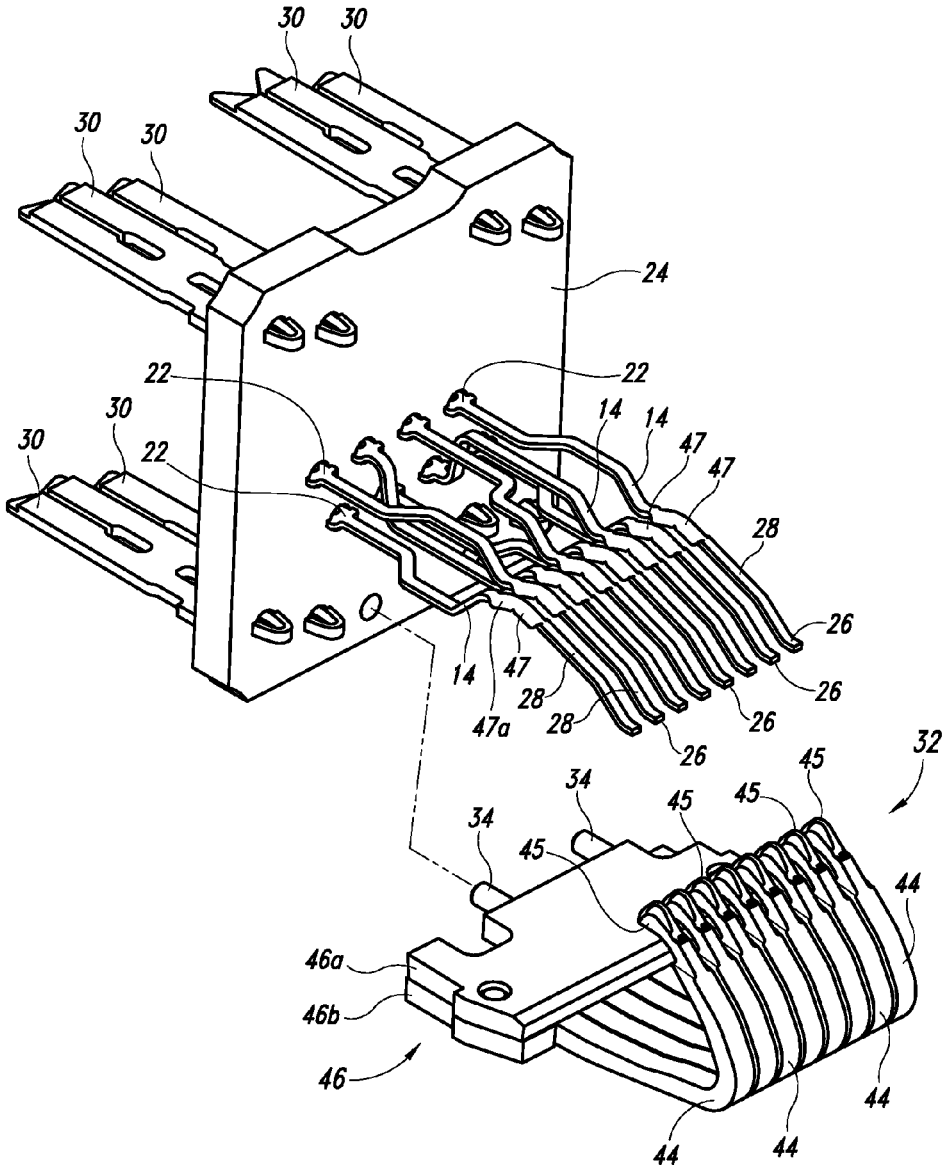
FIG.2 (PRIOR ART)
FIG. 2 is a perspective view of a plurality of tines, a printed circuit board, a plurality of wire contacts, and a spring assembly of the jack of FIG. 1.
Figure 4:
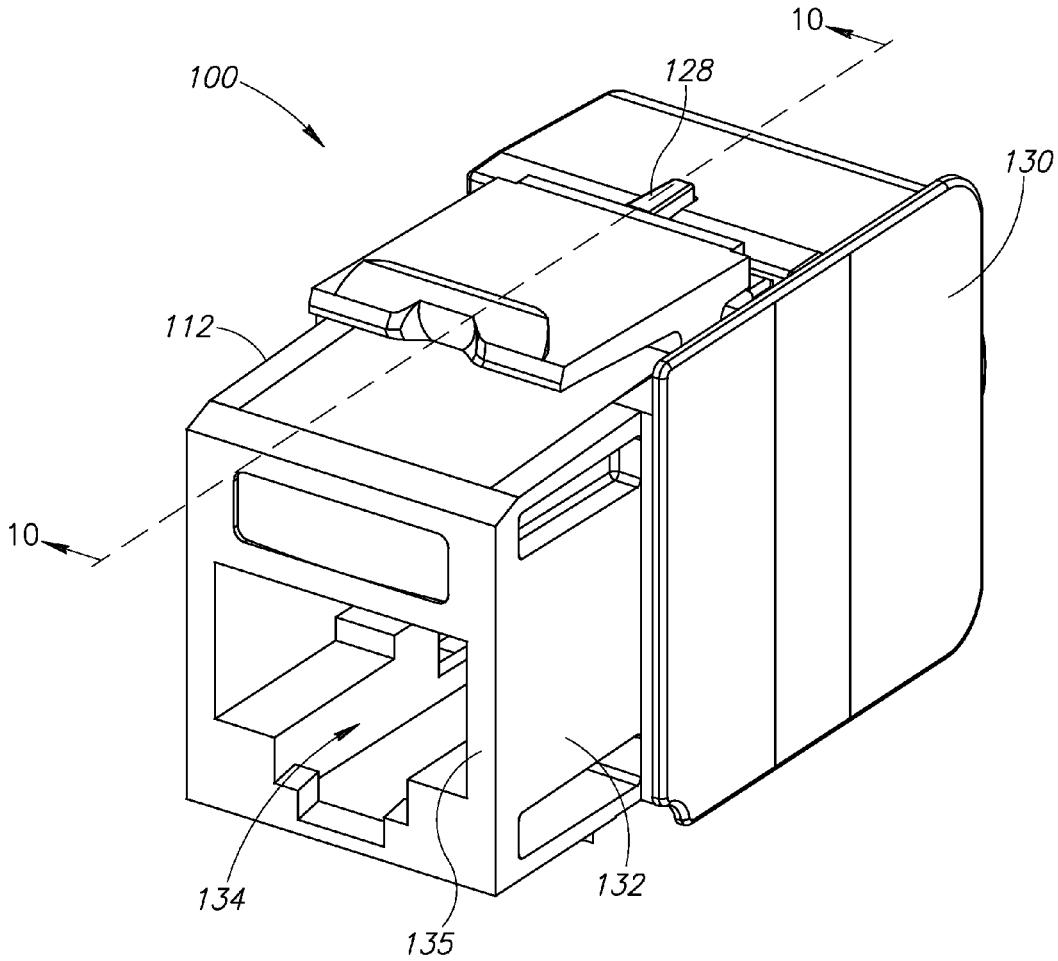
FIG. 4 is a perspective view of a communication jack constructed in accordance with the present invention.

FIG. 4 illustrates a communication jack 100 of a similar construction as shown in FIG. 2. In the embodiment illustrated, the jack 100 has been configured to function as a Category 6 RJ series electrical connector jack. However, this is not a requirement and in alternate embodiments, the jack 100 may be configured in accordance with another style of jack, including but not limited to Category 5, Category 5e, Category 6a, and other styles of telecommunication and non-telecommunication jacks.

Figure 5:
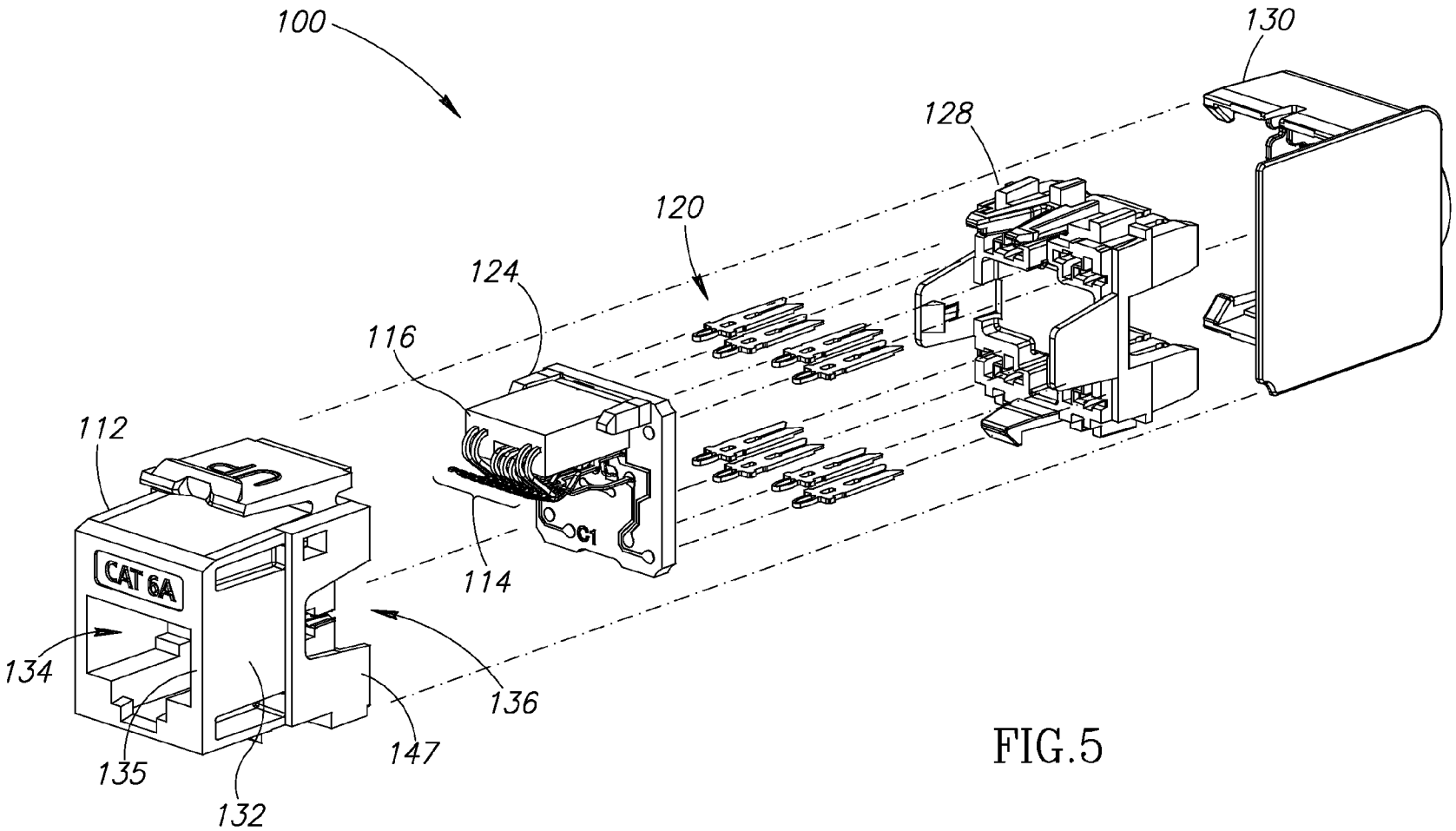
FIG. 5 is a partially exploded perspective view of the jack of FIG. 4.

Referring to FIG. 5, the jack 100 illustrated includes a dielectric housing or body 112, a plurality of resilient contacts or tines 114, a spring assembly 116, a plurality of wire contacts 120, a substrate (depicted as a printed circuit board ("PCB") 124), a carrier or terminal block 128, and an optional shield enclosure 130. Like the prior art jack 10 (illustrated in FIG. 1), the jack 100 is configured for use with the plug 18 (depicted in FIGS. 6 and 10).

Body

The body 112 may be implemented as any body suitable for use in a communication jack. For example, the body 112 may be substantially identical to the body 12 illustrated in FIG. 1 and described in the Background Section. The body 112 includes a sidewall 132 defining an interior receptacle 134. The sidewall 132 includes a frontward opening portion 135 in communication with the interior receptacle 134. As may best be viewed in FIG. 6, which illustrates the backside of the body 112, the sidewall 132 also includes a rearward opening portion 136 opposite the frontward opening portion 135 and in communication with the interior receptacle 134.

Figure 6:
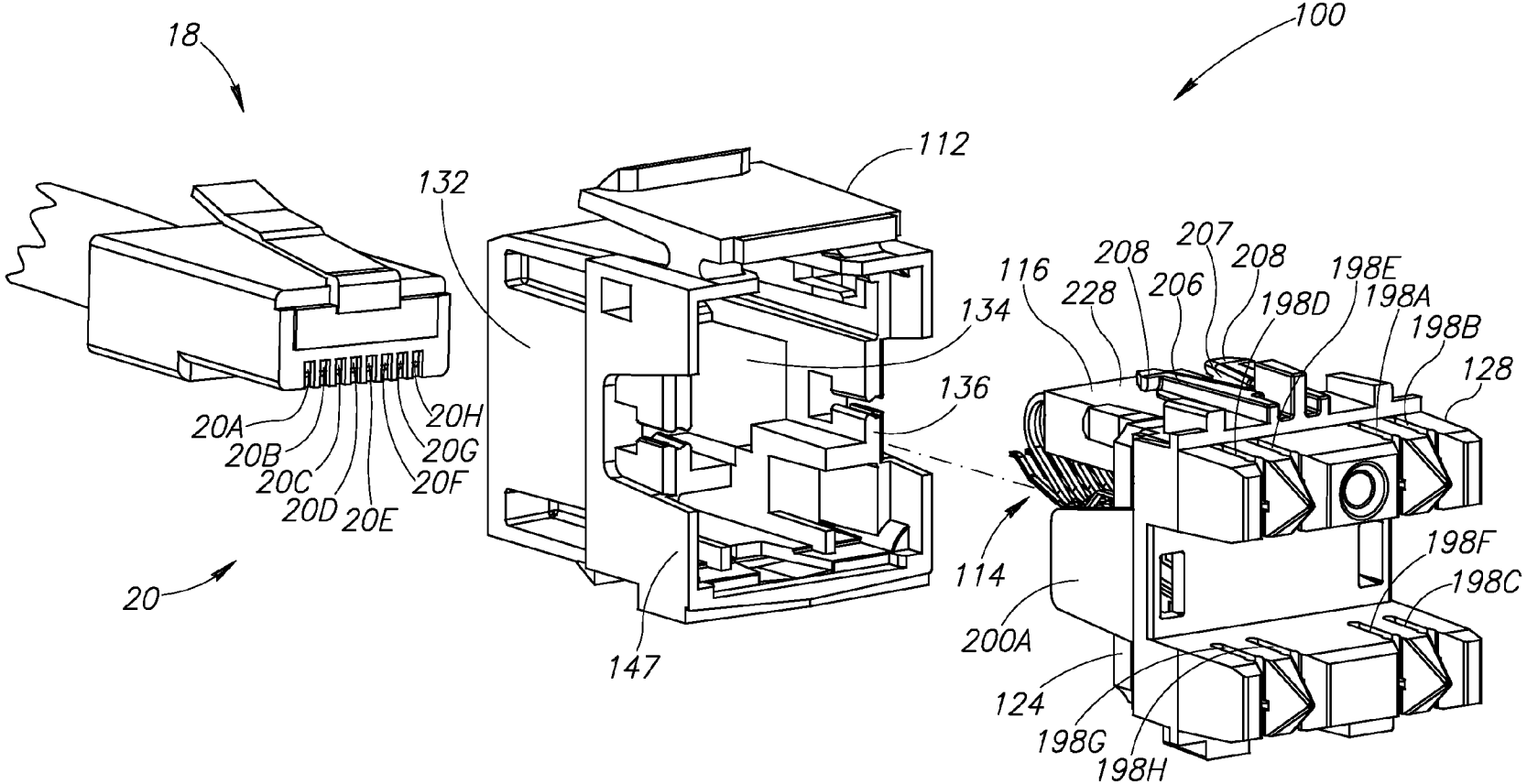
FIG. 6 is a partially exploded perspective view of the jack of FIG. 4 omitting a shield enclosure and illustrated alongside a prior art communication plug.

FIG. 6 also illustrates the plug 18 and its plug contacts 20. In the embodiment illustrated, the plug contacts 20 include eight plug contacts 20A to 20H. However, this is not a requirement. In alternate implementations, a plug having a different number of plug contacts (e.g., 4, 6, 10, 12, 16, etc.) may be used with and inserted inside the jack 100.

Figure 7:
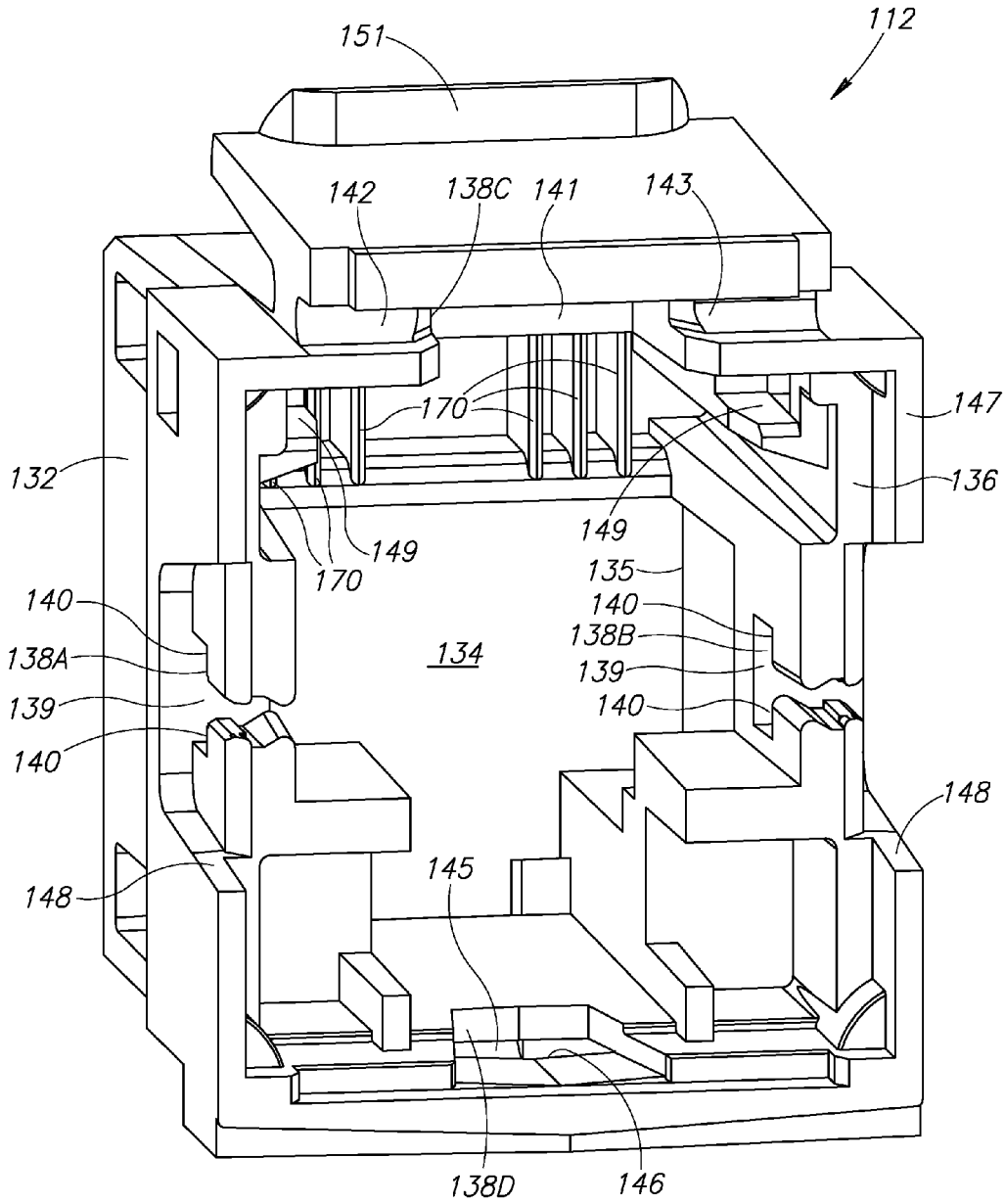
FIG. 7 is a perspective view of the backside of a dielectric outer body of the jack of FIG. 4.

Turning to FIG. 7, which provides an enlarged view of the backside of the body 112, the body 112 also includes one or more connector portions 138A to 138D for attaching the terminal block 128 (see FIG. 6) to the body 112. In the embodiment illustrated, the connector portions 138A to 138D are configured such that the body 112 and the terminal block 128 (see FIG. 6) may be snapped together. In such embodiments, the connector portions 138A to 138D are each configured as a portion of a snap fit connector. The connector portions 138A and 138B are located on opposite sides of the sidewall 132 from one another and each include a recess or an aperture 139 at least partially defined by at least one forward facing surface 140. The connector portions 138C and 138D are located on opposite sides of the sidewall 132 from one another. The connector portion 138C includes a channel 141 defined between a pair of spaced part wall sections 142 and 143 each having a forward facing surface 144 best viewed in FIG. 10. Returning to FIG. 7, the connector portion 138D includes a recess or an aperture 145 adjacent to a forward facing surface 146 best viewed in FIG. 10.

Returning to FIG. 7, the body 112 includes a skirt 147 disposed about an outside portion of the sidewall 132 extending rearwardly beyond the rearward opening portion 136 of the sidewall 132. The skirt 147 is configured to receive the PCB 124 (see FIG. 10) and allow the PCB to abut the rearward opening portion 136 of the sidewall 132. In this manner, the PCB 124 (see FIG. 10) closes the rearward opening portion 136 and cuts off access to the interior receptacle 134 through the rearward opening portion 136. Optionally, the skirt 147 includes a cutout portion 148 adjacent each of the connector portions 138A and 138B to allow access thereto. The skirt 147 prevents the PCB 124 (see FIG. 10) from moving laterally relative to the rearward opening portion 136 of the sidewall 132 and thereby helps maintain the PCB 124 in engagement with the rearward opening portion 136 of the sidewall 132. Optionally, the skirt 147 may be configured to receive at least a portion of the terminal block 128 (see FIG. 10). However, this is not a requirement.

In the embodiment illustrated, in FIG. 7, the body 112 includes dividers 170 configured to fit between adjacent ones of the tines 114A to 114H (see FIG. 11) that help maintain the lateral spacing of the tines and their electrical isolation from one another.

Figure 10:
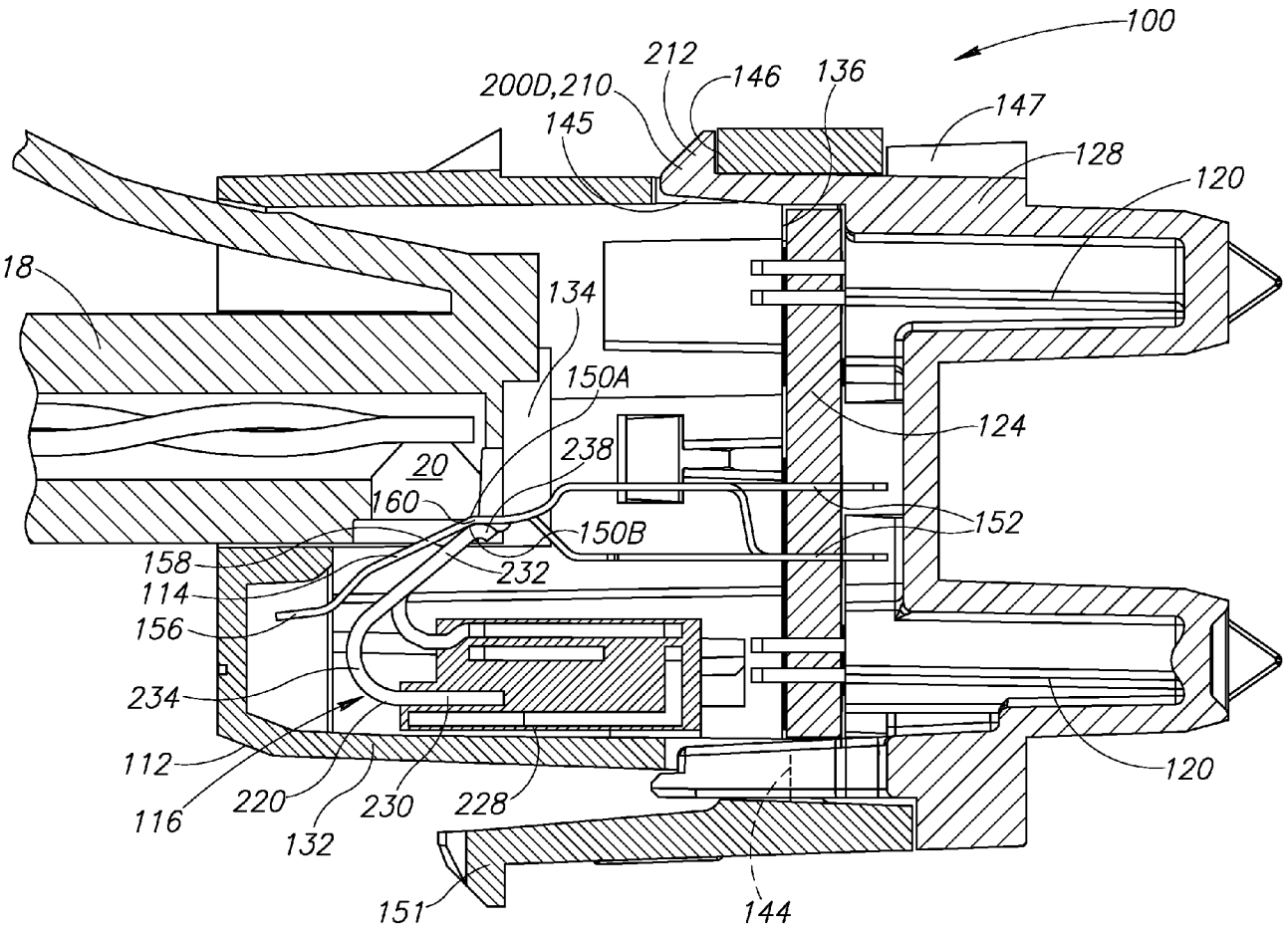
FIG. 10 is a cross-sectional view of the jack taken substantially along line 10-10 of FIG. 4 illustrated with the prior art plug received in the receptacle of the jack and the jack in an orientation that is upside down relative to the orientation of the jack depicted in FIG. 4.

As may be seen in FIG. 10, when the body 112 and the terminal block 128 are coupled together, the PCB 124 is sandwiched therebetween and held in place against the rearward opening portion 136 (see FIG. 7) of the sidewall 132 by the terminal block 128. Returning to FIG. 7, optionally, the body 112 may include recesses or guide rails 149 positioned inside the interior receptacle 134 and accessible via the rearward opening portion 136 of the sidewall 132. The guide rails 149 are configured to guide and/or support the spring assembly 116 (see FIG. 6) inside the interior receptacle 134 relative to the body 112 and the tines 114. Thus, the guide rails 149 position the spring assembly 116 (see FIG. 6) inside the interior receptacle 134 relative to the body 112 and the tines 114.

Optionally, the body 112 may include one or more connector portions 151 configured to (removably or permanently) couple the body 112 inside an aperture (not shown) formed in an external structure (not shown). For example, the connector portions 151 may be used to couple the body 112 inside an aperture (not shown) formed in a patch panel, rack, wall outlet, and the like.

Tines

Figure 8:
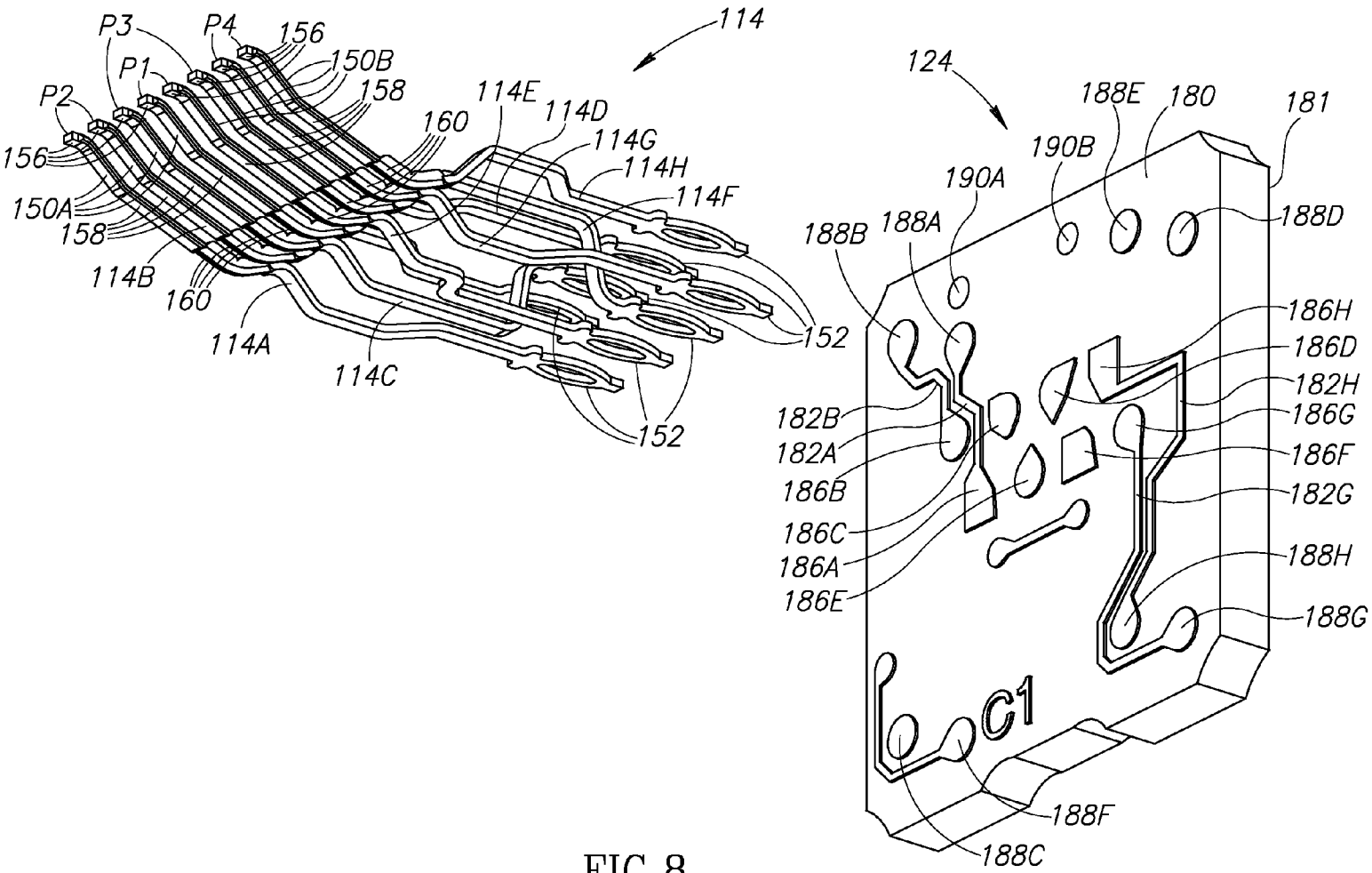
FIG. 8 is a perspective view of the tines and the printed circuit board of the jack of FIG. 4 shown disconnected.

Turning to FIG. 8, in the embodiment illustrated, the tines 114 are substantially identical to the tines 14 (see FIGS. 1-3) described in the Background Section. The jack 100 (see FIGS. 4-6 and 10) includes a tine 114 for each of the plug contacts 20 (see FIG. 6). Thus, in the embodiment illustrated, the plurality of tines 114 includes eight individual tines 114A to 114H that correspond to the eight plug contacts 20A to 20H (see FIG. 6), respectively. Through application of ordinary skill in the art to the present teachings, embodiments including different numbers of tines (e.g., 4, 6, 10, 12, 16, etc.) may be constructed for use with plugs having different numbers of plug contacts.

As is apparent to those of ordinary skill in the art, the tines 114A to 114H are used to transmit differential signals. Thus, the tines 114A to 114H include four differential signal pairs: a first pair "P1" that includes the tines 114D and 114E; a second pair "P2" that includes the tines 114A and 114B; a third or split pair "P3" that includes the tines 114C and 114F; and a fourth pair "P4" that includes the tines 114G and 114H.

Each of the tines 114 has a first side 150A configured for engagement with one of the plug contacts 20 (see FIGS. 6 and 10) and a second side 150B opposite the first side 150A and configured for engagement with the spring assembly 116 (see FIG. 10). Each of the tines 114 has a first end portion 152 configured to be fixedly attached to the PCB 124, and a second free end portion 156 opposite the first end portion 152. Each of the tines 114 also includes a first contact portion 158 and a second contact portion 160 located between the first and second end portions 152 and 156. The first contact portions 158 are in a generally parallel arrangement and are essentially allowed to "float" as simple cantilevered beams.

Figure 1:
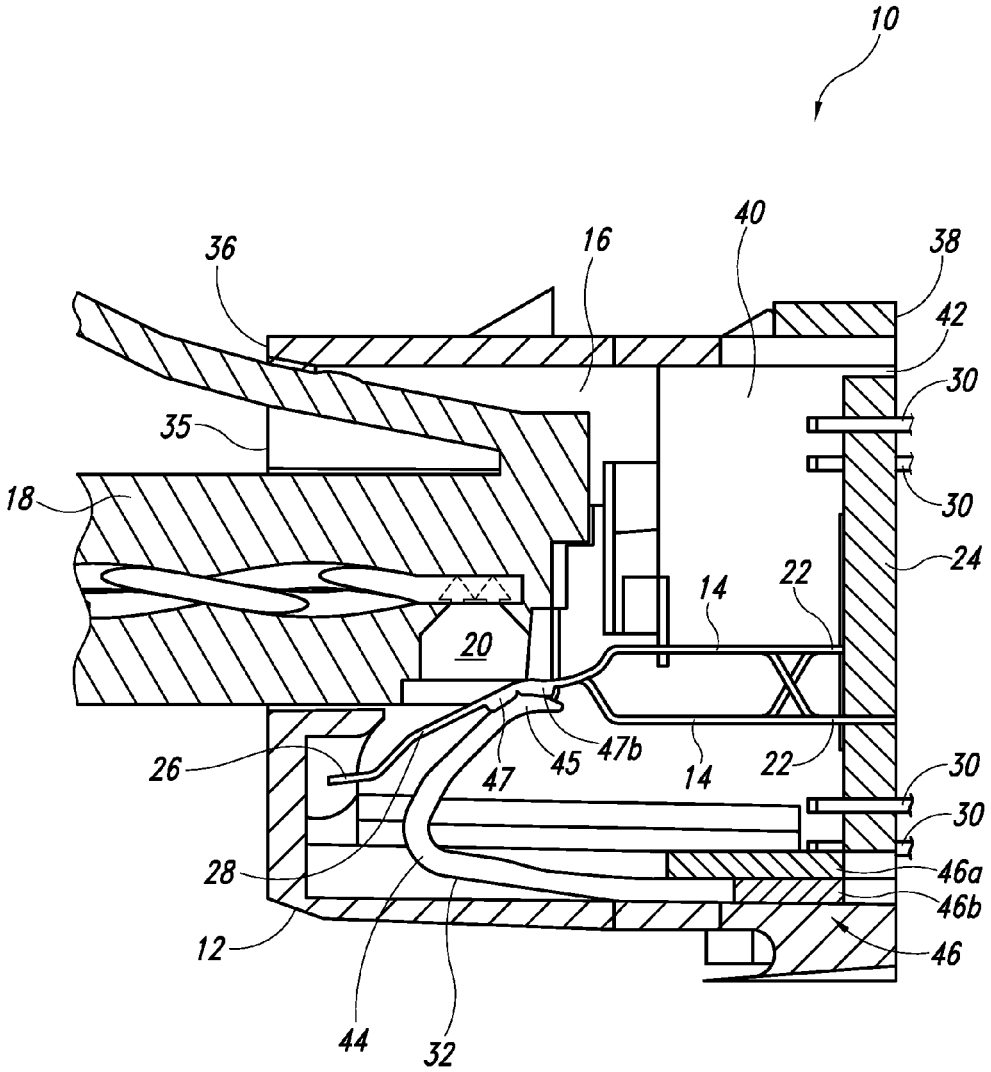
FIG.1 (PRIOR ART)
FIG. 1 is a cross-sectional view of a prior art communication jack.

In FIG. 10, the jack 100 has been illustrated in an upside down orientation relative to the orientation of the jack depicted in FIG. 4 to place the jack 100 in an orientation similar to the orientation of the prior art jack 10 depicted in FIG. 1. Further, the jack 100 has been illustrated with the plug 18 received inside the interior receptacle 134. For illustrative purposes, the optional shield enclosure 130 (see FIGS. 4 and 5) has been omitted from FIG. 10.

The first contact portions 158 are arranged in the body 112 such that the first sides 150A of the tines 114 within the first contact portions are contacted by the plug contacts 20 of the plug 18 when the plug is inserted into the interior receptacle 134. The second contact portions 160 are located between the first contact portions 158 and the first end portions 152. Thus, the second contact portions 160 are forward of the first end portions 152 of the tines 114 and rearward of the first contact portions 158.

As illustrated in FIG. 10, the tines 114 are coupled to the PCB 124 by their first end portions 152 such that they extend into the interior receptacle 134. As mentioned above, within the interior receptacle 134, the tines 114 are arranged in a parallel arrangement to engage the plug contacts 20. The tines 114 are positioned such that their first sides 150A within the first contact portions 158 are contacted by the contacts 20 of the plug 18 when the plug 18 is inserted into the interior receptacle 134 and make electrical contact therewith.

Figure 9:
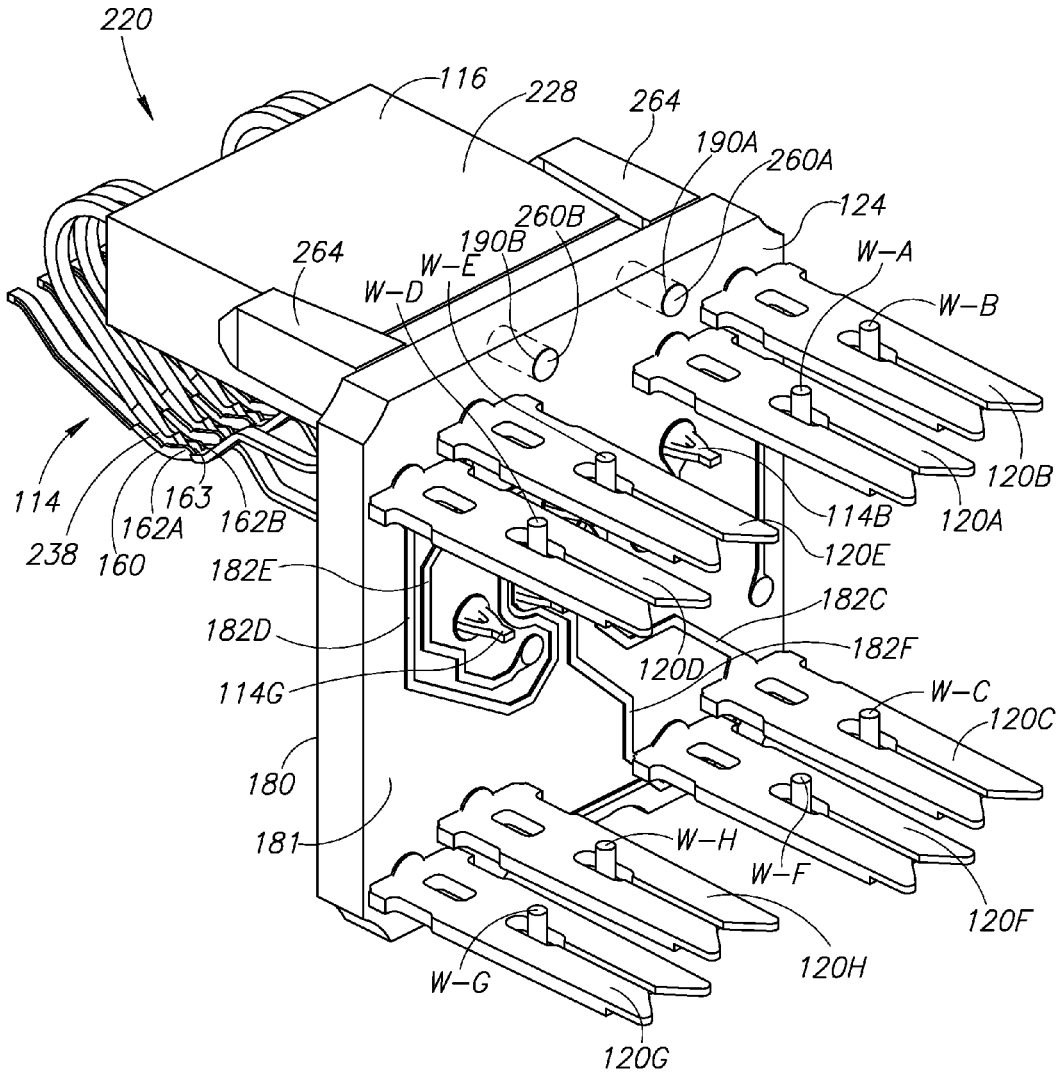
FIG. 9 is a perspective view of the backside of the printed circuit board with a plurality of tines, a spring assembly, and a plurality of wire connectors connected thereto.
Figure 11:
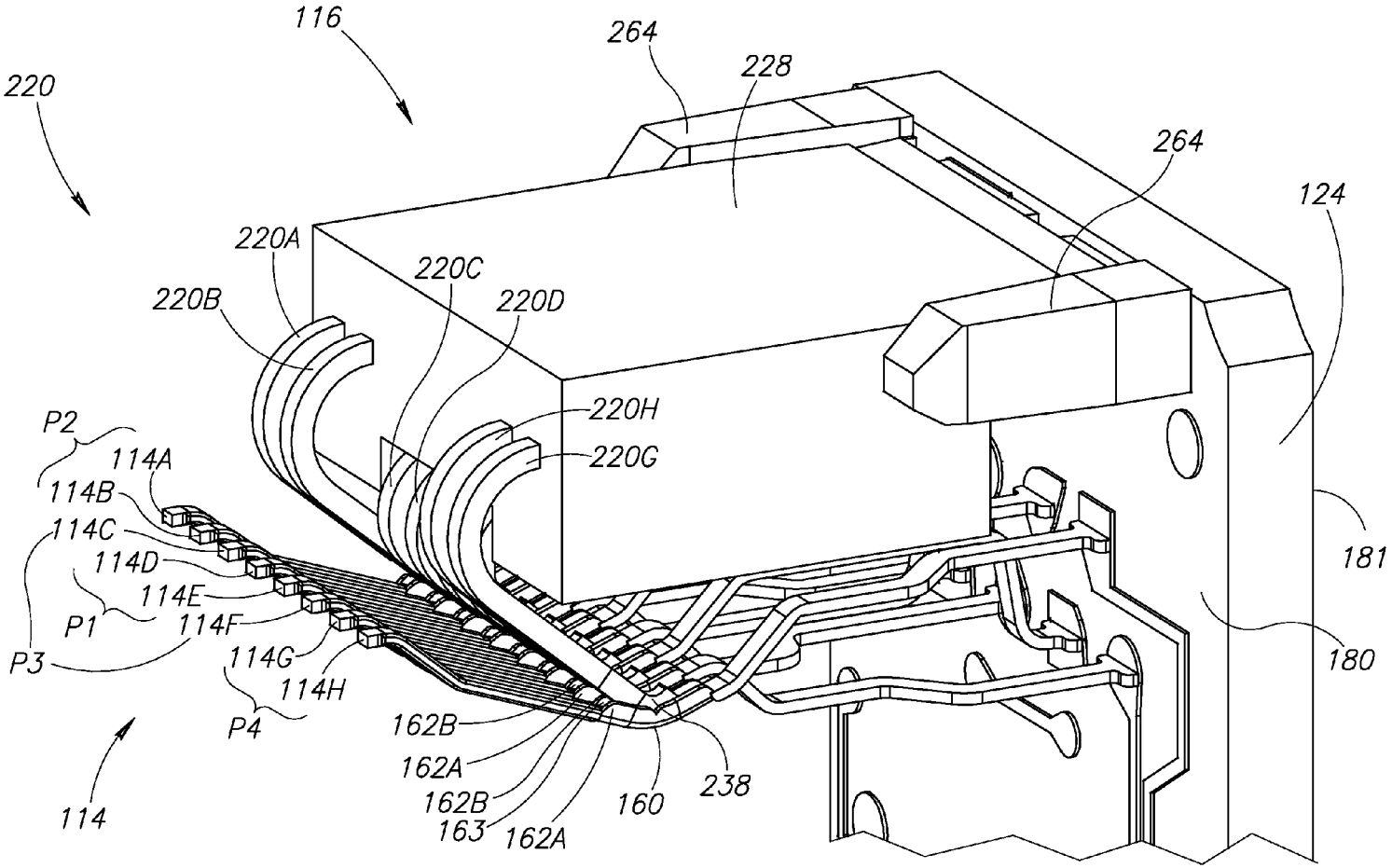
FIG. 11 is a perspective view of the front side of the printed circuit board of FIG. 8 with the plurality of tines and the spring assembly connected thereto.

The second contact portions 160 of the tines 114 are configured such that the second sides 150B of the tines within the second contact portions 160 are engaged by the spring assembly 116. Turning to FIGS. 9 and 11, in the embodiment illustrated, the second contact portions 160 each include a first side rail 162A spaced apart laterally from a second side rail 162B. In each of the second contact portions 160, the first and second side rails 162A and 162B extend in a substantially parallel manner along a portion the tine 114 to define a longitudinally extending channel 163 therebetween.

Turning to FIG. 10, the tines 114A to 114H are laterally spaced apart from one another so that the first contact portions 158 of each tine is contacted by a correspondingly positioned one of the plug contacts 20A to 20H (see FIG. 6) when the plug 18 is inserted into the interior receptacle 134. When the plug contacts 20A to 20H press against the contacted tines 114A to 114H, respectively, the contacted tines deflect in a generally outward direction, with a small rearward component, in response to the inwardly directed force. In other words, the tines 114A to 114H flex outwardly in response to having been contacted by the plug contacts 20A to 20H, respectively.

Each of the tines 114A to 114H is sufficiently resilient to produce a first generally inward force, with an optional forward component, in opposition to the outward force applied by the corresponding one of the plug contact 20A to 20H, respectively. The opposing forces of the plug contacts 20 and the tines 114 provide a contact force between the tine 114 and the plug contact 20 that helps provide good electrical contact therebetween. Depending upon the implementation details, it may be desirable to keep the tines 114 as short as possible to improve electrical performance of the jack, while still providing sufficient resiliency to accommodate legacy plugs and contact force needed to meet FCC standards.

Wire Contacts

Figure 12:
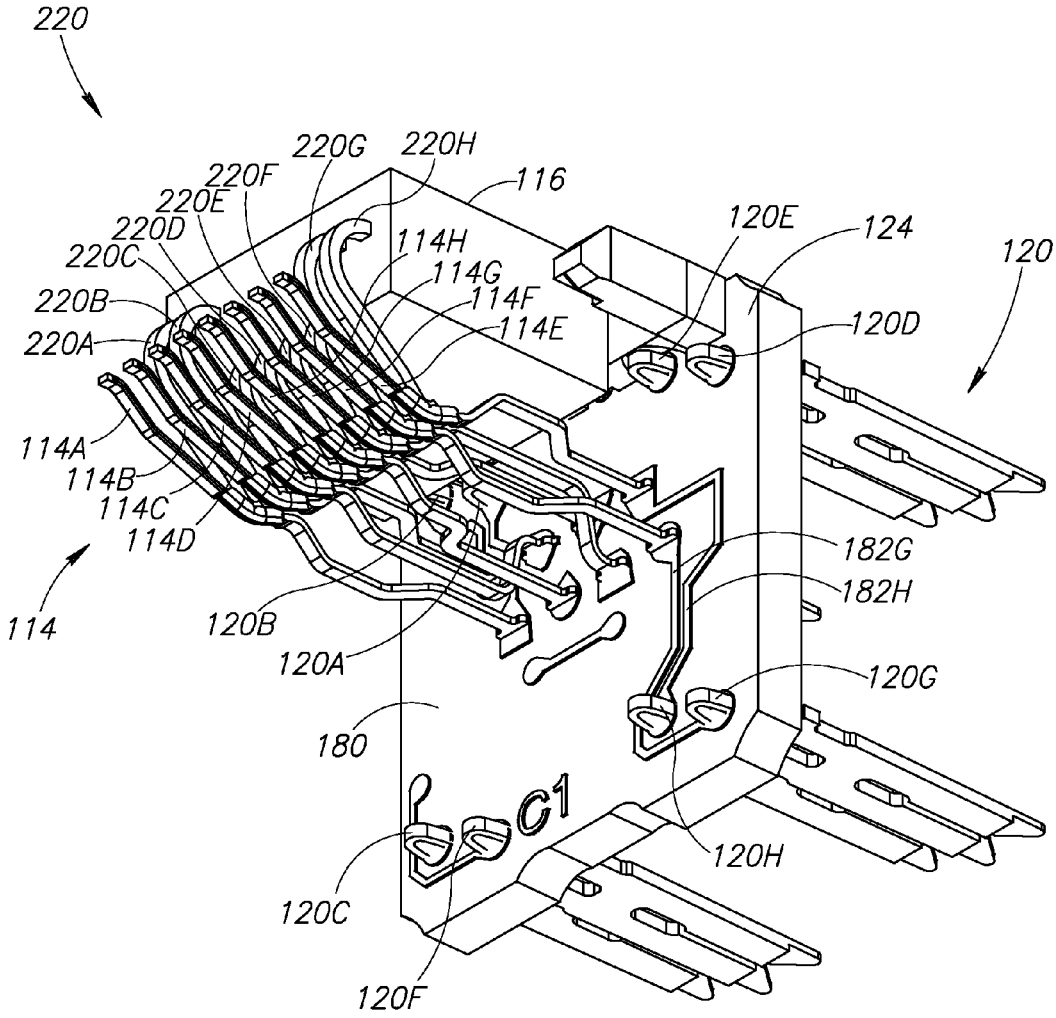
FIG. 12 is another perspective view of the front side of the printed circuit board of FIG. 11 with the plurality of tines, the spring assembly, and the plurality of wire connectors connected thereto.

As illustrated in FIGS. 5 and 12, each of the wire contacts 120 may be implemented as an insulation displacement connector ("IDC"). However, this is not a requirement and embodiments in which the wire contacts 120 are implemented in another manner are also within the scope of the present teachings. Turning to FIG. 12, the jack 100 (see FIGS. 4-6 and 10) includes a wire contact for each of the tines 114. Thus, in the embodiment illustrated, the wire contacts 120 include eight wire contacts 120A to 120H. The PCB 124 connects the tines 114A to 114H to the wire contacts 120A to 120H, respectively. Wire contacts, such as the wire contacts 120, used in communication jacks are well known in the art and will not be described in detail herein.

Printed Circuit Board

Returning to FIGS. 8 and 9, the PCB 124 has a first forwardly facing side 180 opposite a second rearwardly facing side 181. The PCB 124 includes circuit paths 182A to 182H formed on one or both of the first and second sides 180 and 181. The circuit paths 182A to 182H electrically connect the tines 114A to 114H, respectively, to the wire contacts 120A to 120H, respectively. The PCB 124 includes apertures 186A to 186H configured to receive the first end portion 152 of the tines 114A to 114H, respectively, and electrically connect the tines 114A to 114H to the circuit paths 182A to 182H, respectively. The PCB 124 also includes apertures 188A to 188H configured to receive each of the wire contacts 120A to 120H, respectively, and electrically connect the wire contacts 120A to 120H to the circuit paths 182A to 182H, respectively. As may best be viewed in FIG. 9, wires "W-A" to "W-H" carrying electrical signals may be connected to the wire contacts 120A to 120H, respectively, in a conventional manner. Further, other style contacts and means may be used to electrically connect signals to the tines 114.

Turning to FIG. 10, as mentioned above, the PCB 124 is configured to at least partially close the rearward opening portion 136 of the body 112. The wire contacts 120 are coupled to the PCB 124 such that when the PCB 124 at least partially closes the rearward opening portion 136, the wire contacts 120 extend rearwardly away from the PCB 124 and into the terminal block 128.

Returning to FIGS. 8 and 9, in the embodiment illustrated, the first end portions 152 of the tines 114 may be pressed into the apertures 186A to 186H from the first forwardly facing side 180 of the PCB 124 and the wire contacts 120A to 120H may be pressed into the apertures 188A to 188H, respectively, in the PCB 124 from the second rearwardly facing side 181 of the PCB 124. Thus, the tines 114 and wire contacts 120 extend away from the PCB 124 in opposite directions. The tines 114 may be subsequently soldered into place.

The PCB 124 also includes apertures 190A and 190B configured to receive and support the spring assembly 116.

While the jack 100 is illustrated and discussed as implemented as a Category 6 jack, it should be understood that the present teachings may be useful for other style jacks, including but not limited to Category 5, Category 5e, Category 6a, and other telecommunication and non-telecommunication jacks, and that such jacks need not utilize a printed circuit board mounting for the tines 114, the spring assembly 116, or other components. Further, the jack 100 need not include a printed circuit board.

Terminal Block

Turning to FIG. 5, the terminal block 128 may be implemented using any terminal block known in the art configured to be assembled with the body 112 to enclose and protect the internal components (i.e., the tines 114, the spring assembly 116, the PCB 124, and portions of the wire contacts 120) of the jack 100. As is apparent to those of ordinary skill in the art, at least a portion of each of the wire contacts 120A to 120H may be accessible from outside the jack 100 so that the wires "W-A" to "W-H" (see FIG. 9) may be connected to the wire contacts 120A to 120H. Thus, the terminal block 128 may be configured to provide access to those portions of the wire contacts 120A to 120H.

Figure 13:
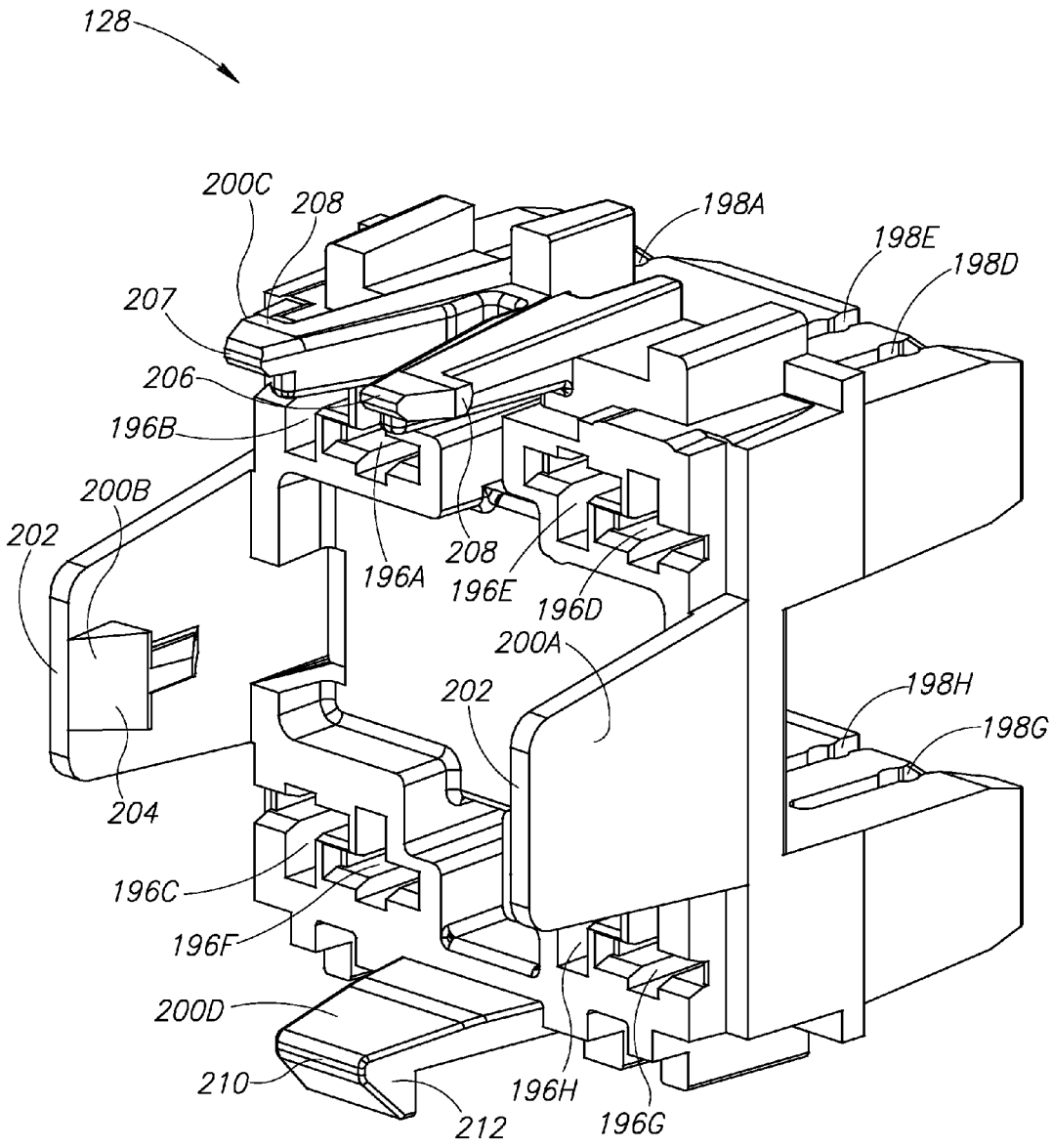
FIG. 13 is a perspective view of the front side of a terminal block of the jack of FIG. 4.

As mentioned above, inside the jack 100, the PCB 124 is positioned adjacent to the receptacle 134 with the tines 114 projecting forward into the receptacle and the wire contacts 120 extending in the opposite direction or rearwardly toward the terminal block 128. The terminal block 128 is mounted on the body 112 adjacent to the skirt 147. When so mounted, the terminal block 128 captures and holds the PCB 124 in place. Referring to FIG. 13, in the embodiment illustrated, the terminal block 128 includes a slot 196A to 196H for each of the wire contacts 120A to 120H, respectively. When the jack 100 is assembled, the wire contacts 120A to 120H (see FIG. 9) are received inside the slots 196A to 196H, respectively. As may best be seen in FIG. 6, each of the slots 196A to 196H (see FIG. 13) has an open rearwardly facing portion 198A to 198H, respectively, through which the wires "W-A" to "W-H" (see FIG. 9), respectively, may be connected to the wire contacts 120A to 120H, respectively.

As mentioned above, in the embodiment illustrated in FIG. 7, the body 112 includes the connector portions 138A to 138D configured to effect a snap fit connection between the body 112 and the terminal block 128. In such embodiments, as illustrated in FIGS. 13 and 7, the terminal block 128 includes one or more connector portions 200A to 200D configured to be connected to the connector portions 138A to 138D, respectively, of the body 112. The connector portions 138A and 138B, which are located on opposite sides of the sidewall 132 of the body 112, each include the aperture 139, which is at least partially defined by the forward facing surfaces 140. The connector portions 200A and 200B of the terminal block 128 are positioned to engage the connector portions 138A and 138B of the body 112. For example, the connector portions 200A and 200B each include a cantilever forward projecting gripping finger 202 having an inwardly extending tab 204 configured to be received inside the aperture 139 and when so received, to bear against the forward facing surface 140.

As mentioned above, the connector portion 138C includes the channel 141 defined between the spaced part wall sections 142 and 143 each having a forward facing surface 144 (see FIG. 10). The connector portion 200C of the terminal block 128 is positioned to engage the connector portion 138C of the body 112. For example, the connector portion 200C may include a pair of cantilever forward projecting gripping fingers 206 and 207 configured to be received inside the channel 141 between the spaced part wall sections 142 and 143. The gripping fingers 206 and 207 may each include a tab 208 configured to engage the forward facing surface 144 (see FIG. 10) of the wall sections 142 and 143, respectively, when the gripping fingers 206 and 207 are received inside the channel 141.

As mentioned above and illustrated in FIG. 7, the connector portion 138D includes the recess or aperture 145, which is adjacent the forward facing surface 146 (best viewed in FIG. 10). Turning to FIG. 13, the connector portion 200D of the terminal block 128 is positioned to engage the connector portion 138D of the body 112. For example, the connector portion 200D may include a cantilever forward projecting gripping finger 210 configured to be received inside the aperture 145. The gripping fingers 210 may each include a tab 212 configured to engage the forward facing surface 146 (best viewed in FIG. 10) when the gripping finger 210 is received inside the aperture 145.

Alternate methods and structures for coupling the body 112 and the terminal block 128 together are known in the art and the present teachings are not limited to use with any particular method or structure. The structures discussed above are provided merely for illustrative purposes and are not intended to be limiting.

Spring Assembly

As illustrated in FIG. 10, the spring assembly 116 is positioned adjacent to the tines 114 to provide an increased contact force and resiliency compared to the contact force produced by the tines alone in response to being bent by the plug contacts 20 of the plug 18 as the plug is inserted into the interior receptacle 134. Thus, the tines 114 need not be longer than desired to provide good electrical performance. The increased resiliency allows the insertion of legacy plugs (not shown) into the interior receptacle 134 and the resulting flexure of the tines 114 in response thereto, without permanent deformation of the tines.

Turning to FIG. 11, the spring assembly 116 includes spring members or arms 220 each connected to a dielectric or non-conductive base 228. The spring assembly 116 includes a spring arm 220 for each of the tines 114. Thus, turning to FIG. 14, in the embodiment illustrated, the spring arms 220 include eight individual spring arms 220A to 220H, which correspond to the tines 114A to 114H, respectively. The spring arms 220A to 220H extend forward from the spring assembly base 228 (see FIG. 11). The spring arms 220A to 220H are constructed from a conductive material.

Returning to FIG. 10, each of the spring arms 220 includes an anchored portion 230, a tine engaging portion 232, and a bent portion 234 positioned between the anchored portion 230 and the tine engaging portion 232. The anchored portion 230 is coupled inside the non-conductive base 228 and is insulated thereby. Further, the non-conductive base 228 insulates the spring arms 220A to 220H from one another. The other portions of the spring arms 220 are located outside the non-conductive base 228 and are not insulated thereby. The bent portions 234 position the tine engaging portions 232 of the spring arms 220 to engage the second contact portions 160 of the tines 114. Opposite the bent portion 234, the tine engaging portion 232 has a free end portion 238.

Figure 17:
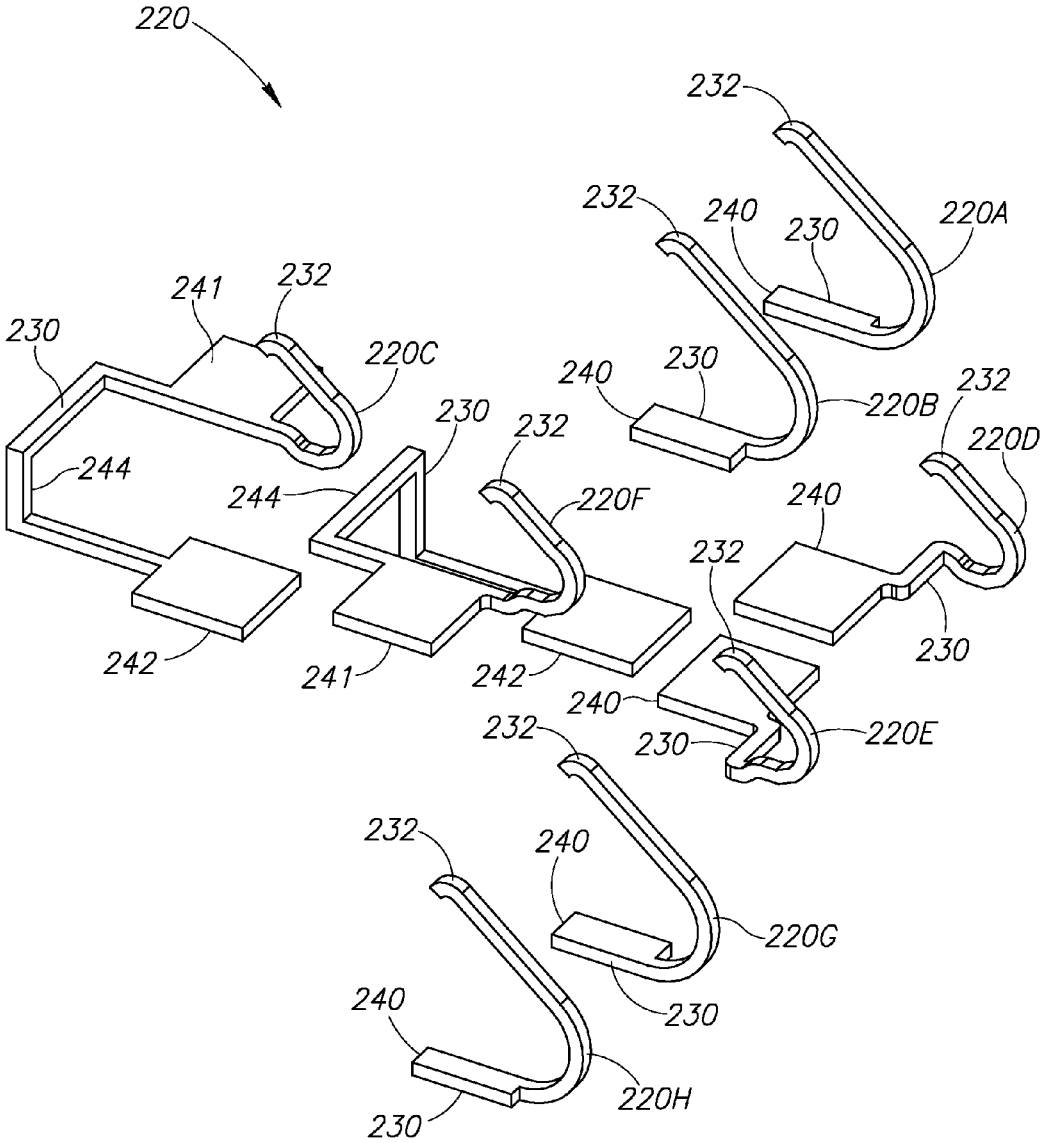
FIG. 17 is an exploded perspective view of the spring arms of the spring assembly of FIG. 4.

Turning to FIG. 17, the anchored portions 230 of the spring arms 220A to 220H each include at least one capacitor plate portion. In the embodiment illustrated, the anchored portions 230 of the spring arms 220A, 220B, 220D, 220E, 220G, and 220H each include a single capacitor plate portion 240 and the anchored portions 230 of the spring arms 220C and 220F each include a first capacitor plate portion 241 and a second capacitor plate portion 242.

In the embodiment illustrated, the first capacitor plate portions 241 of the spring arms 220C and 220F are positioned on between the second capacitor plate portions 242 and the bent portions 234 of the spring arms 220C and 220F. Further, the anchored portions 230 of the spring arms 220C and 220F each include a bent anchor portion 244 that positions the second capacitor plate portions 242 farther away (in a downward direction) from the tines 114 than the first capacitor plate portions 241. Thus, the anchored portions 230 of the spring arms 220A and 220B may be longer than the anchored portions 230 of the spring arms 220D and 220E to position the capacitor plate portions 240 of the spring arms 220A and 220B adjacent the second capacitor plate portion 242 of the spring arm 220F. Similarly, the anchored portions 230 of the spring arms 220G and 220H are longer than the anchored portions 230 of the spring arms 220D and 220E to position the capacitor plate portions 240 of the spring arms 220G and 220H adjacent the second capacitor plate portion 242 of the spring arm 220C.

Figure 14:
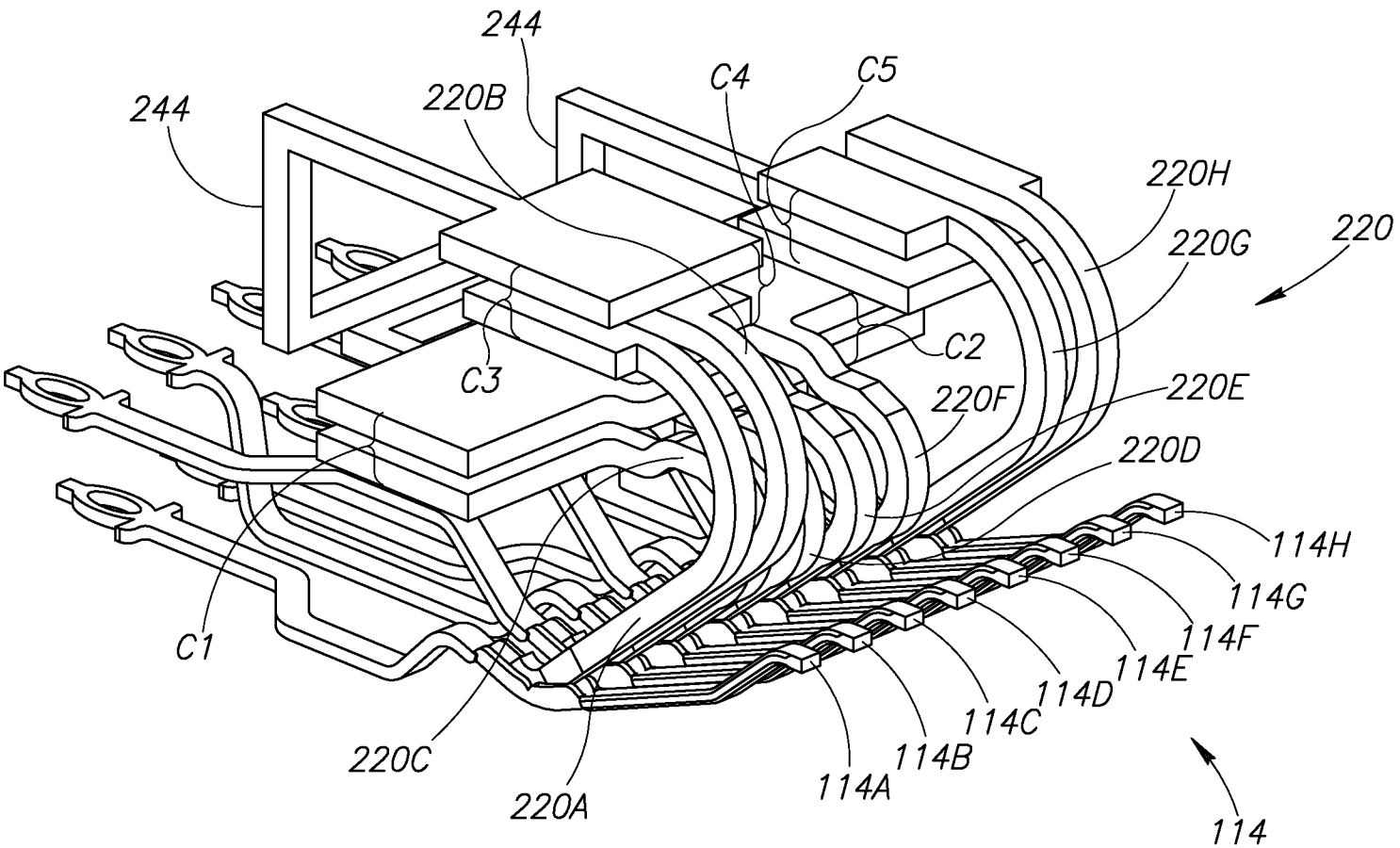
FIG. 14 is a perspective view of the front side of the spring assembly and tines of the jack of FIG. 4.
Figure 15:
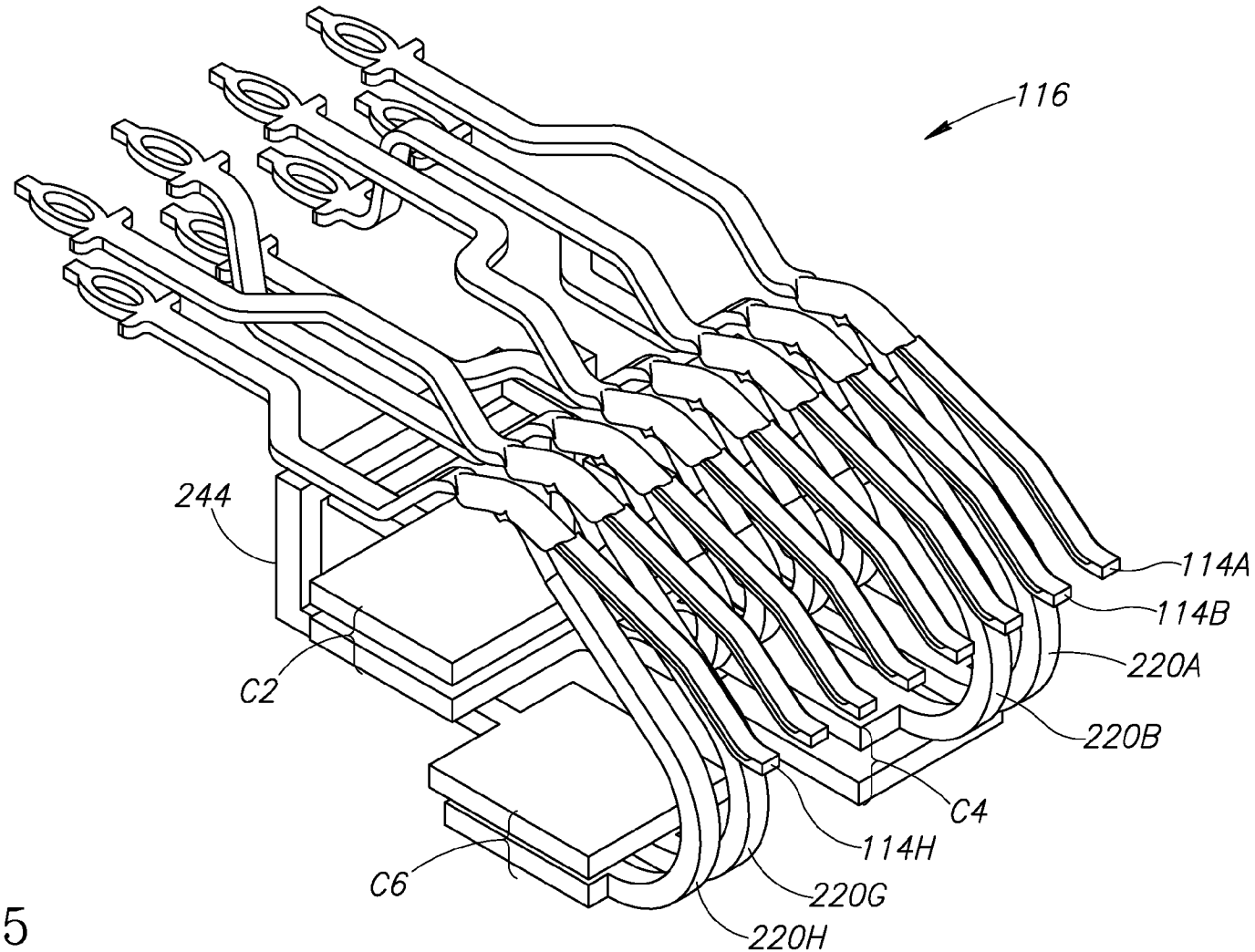
FIG. 15 is a perspective view of the spring assembly and tines of the jack of FIG. 4.
Figure 16:
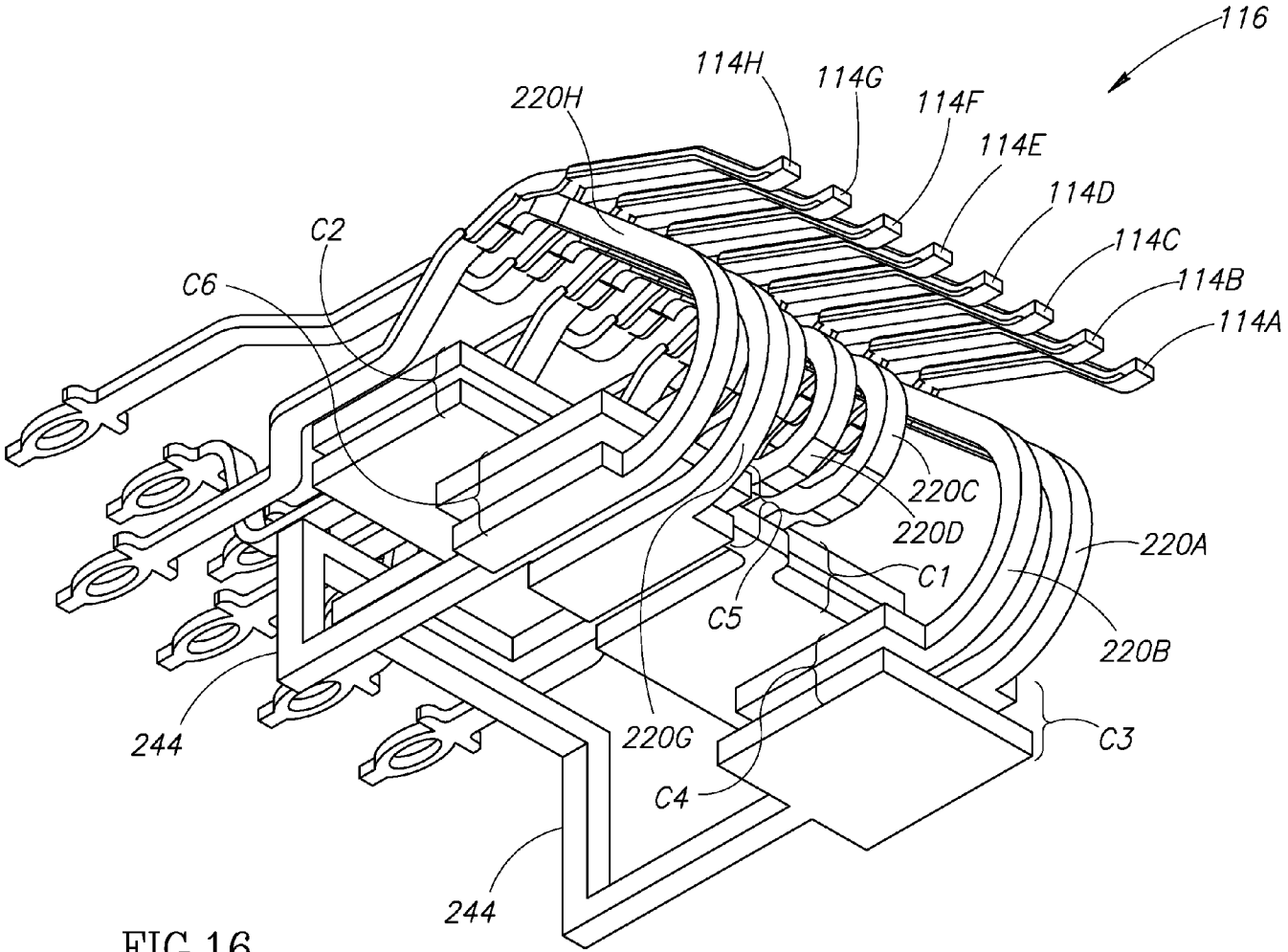
FIG. 16 is a perspective view of the spring assembly and tines of the jack of FIG. 4.

Inside the non-conductive base 228 (see FIGS. 9, 11, and 12), the first capacitor plate portion 241 of the spring arm 220C is adjacent the capacitor plate portion 240 of the spring arm 220E to form a first capacitor "C1" (see FIGS. 14 and 16). The capacitor plate portion 240 of the spring arm 220D is adjacent the first capacitor plate portion 241 of the spring arm 220F to form a second capacitor "C2" (see FIGS. 14-16) spaced apart laterally from the first capacitor "C1."

The capacitor plate portion 240 of the spring arm 220A is adjacent the second capacitor plate portion 242 of the spring arm 220F to form a third capacitor "C3" (see FIGS. 14 and 16). The capacitor plate portion 240 of the spring arm 220B is also adjacent the second capacitor plate portion 242 of the spring arm 220F to form a fourth capacitor "C4" (see FIGS. 14-16). Thus, the third and fourth capacitors "C3" and "C4" share the second capacitor plate portion 242 of the spring arm 220F and are therefore electrically coupled together.

The capacitor plate portion 240 of the spring arm 220G is adjacent the second capacitor plate portion 242 of the spring arm 220C to form a fifth capacitor "C5" (see FIGS. 14 and 16). The capacitor plate portion 240 of the spring arm 220H is also adjacent the second capacitor plate portion 242 of the spring arm 220C to form a sixth capacitor "C6" (see FIGS. 15 and 16). Thus, the fifth and sixth capacitors "C5" and "C6" share the second capacitor plate portion 242 of the spring arm 220C and are therefore electrically coupled together.

In the embodiment illustrated, in the fifth and sixth capacitors "C5" and "C6," the second capacitor plate portion 242 of the spring arm 220C is positioned between the capacitor plate portions 240 of the spring arms 220G and 220H and the tines 114. In alternate embodiments, in the fifth and sixth capacitors "C5" and "C6," the capacitor plate portions 240 of the spring arms 220G and 220H may be positioned between the second capacitor plate portion 242 of the spring arm 220C and the tines 114.

In the embodiment illustrated, in the third and fourth capacitors "C3" and "C4," the capacitor plate portions 240 of the spring arms 220A and 220B are positioned between the second capacitor plate portion 242 of the spring arm 220F and the tines 114. In alternate embodiments, in the third and fourth capacitors "C3" and "C4," the second capacitor plate portion 242 of the spring arm 220F may be positioned between the capacitor plate portions 240 of the spring arms 220A and 220B and the tines 114.

In the embodiment illustrated, the spring arms 220A, 220B, 220G, and 220H extend downwardly away from the tines 114 by approximately the same distance. Thus, the spring arm 220F extends downwardly away from the tines 114 by a greater distance than the spring arm 220C. In other words, in the embodiment illustrated, the anchored portion 230 of the spring arm 220F is longer than the anchored portion 230 of the spring arm 220C. However, this is not a requirement. In alternate embodiments, the spring arm 220C may extend downwardly away from the tines 114 by a greater distance than the spring arm 220F extends downwardly away from the tines. By way of yet another non-limiting example, the spring arms 220C and 220F may extend downwardly away from the tines 114 by substantially the same distance.

As shown in FIG. 9, the non-conductive base 228 includes projections 260A and 260B configured to be received into the apertures 190A and 190B, respectively, formed in the PCB 124 and illustrated in FIG. 8. The projections 260A and 260B are inserted into the apertures 190A and 190B, respectively, along the first forwardly facing side 180 of the PCB 124 to position the spring arms 220 on the same side of the PCB 124 as the tines 114. Turning to FIG. 5, the PCB 124 with the tines 114, the spring assembly 116, and the wire contacts 120 attached thereto is received inside the skirt 147 adjacent the rearward opening portion 136 of the sidewall 132 of the body 112. The PCB 124 is positioned adjacent to the receptacle 134 with both the tines 114 and the spring arms 220 projecting forward into the receptacle and the wire contacts 120 extending rearwardly into the terminal block 128 as described above.

Returning to FIG. 9, the non-conductive base 228 may include guides 264 configured to travel along the optional guide rails 149 (see FIG. 7) formed in the body 112. The rails 149 may align and hold the guides 264 and thereby align and hold the conductive spring arms 220 in position for contact with the tines 114.

Figure 3:
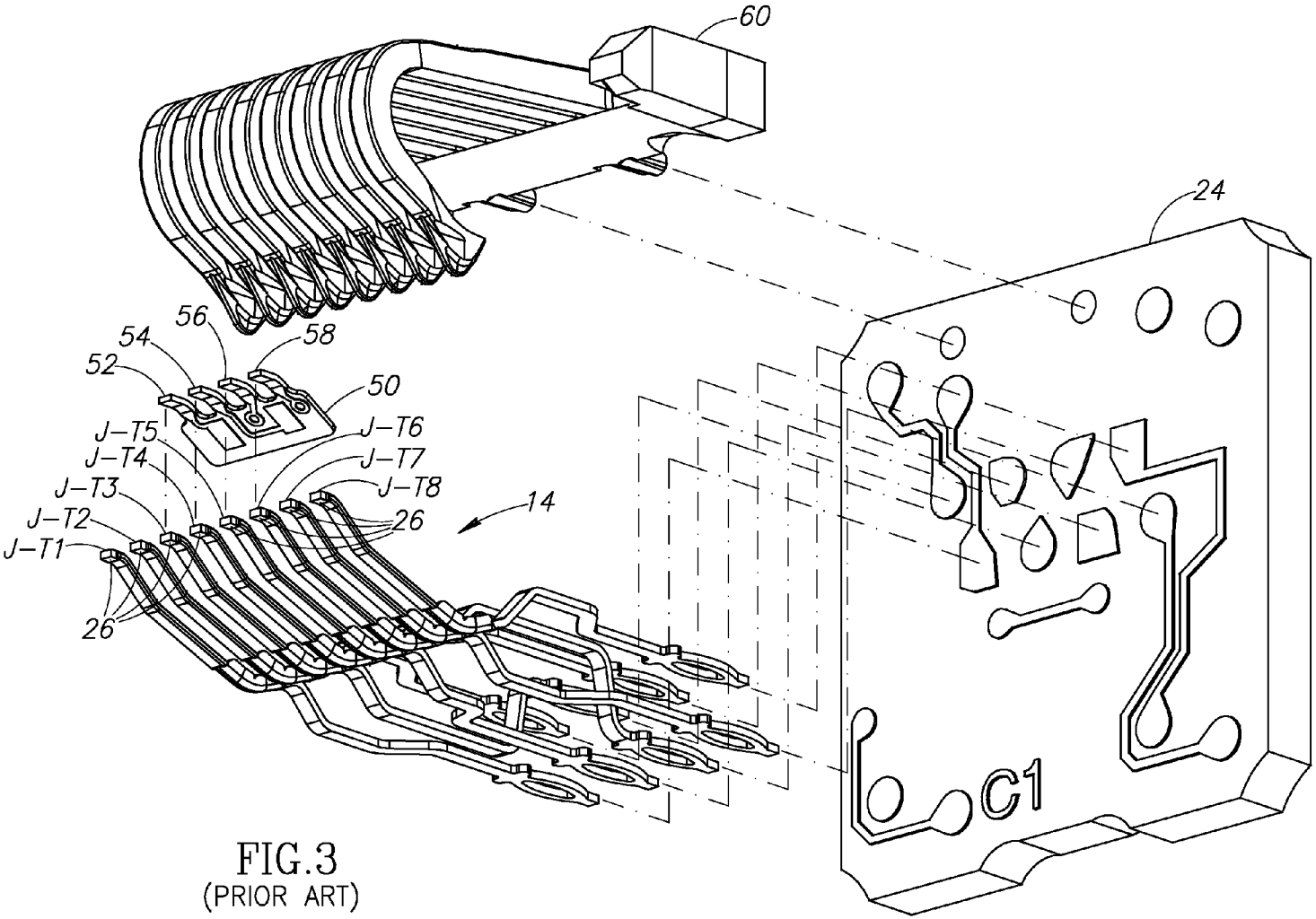
FIG.3 (PRIOR ART)
FIG. 3 is a perspective view of the plurality of tines, the printed circuit board, a flexible printed circuit board configured to be soldered to the plurality of tines to provide crosstalk compensation, and an alternate embodiment of a spring assembly for use inside the jack of FIG. 1.

Turning to FIG. 10, like the prior art spring arms 44 depicted in FIGS. 1-3, the spring arms 220 help effect contact between the tines 114 and the plug contacts 20. Inside the receptacle 134, the spring arms 220A to 220H are positioned immediately adjacent to the tines 114A to 114H, respectively. The free end portions 238 of the spring arms 220A to 220H are configured to contact the second contact portion 160 of the tines 114A to 114H, respectively, on the second side 150B of the tine while the first sides 150A of the tines 114A to 114H are contacting the plug contacts 20A to 20H, respectively.

As may be viewed in FIGS. 9 and 11, each of the spring arms 220A to 220H is positioned such that their free end portions 238 are received inside the channel 163 of the second contact portions 160 of the tines 114A to 114H, respectively. The first and second side rails 162A and 162B help maintain alignment of the spring arms 220A to 220H with the tines 114A to 114H, respectively. The first and second side rails 162A and 162B also allow the spring arms 220A to 220H to slide forward and backward along the tines 114A to 114H, respectively, as the tines and spring arms are deflected by engagement with the plug contacts 20A to 20H (see FIG. 6), respectively.

Returning to FIG. 10, as described above, when the plug 18 is inserted into the interior receptacle 134, the plug contacts 20A to 20H contact the tines 114A to 114H, respectively, causing them to deflect. As the tines 114A to 114H are deflected, they press against the free end portions 238 of the spring arms 220A to 220H, respectively, causing the spring arms to flex or deflect. The free end portions 238 move away from the plug contacts 20 with a small rearward component because the tines 114 each deflect along an arcuate path of motion.

The spring arms 220 are separated laterally from each other to allow the spring arms 220 to move independently. The spring arms 220A to 220H apply a supplemental contact force to the tines 114A to 114H that opposes the movement of the tines in response to the plug contacts. The supplemental contact force applied by the spring arms 220 is transmitted to the plug contacts 20 by the tines 114. The supplemental contact force increases the contact force between the tines 114 and the plug contacts 20 (which for each of the tines 114, is generally the sum of the first force and the supplemental contact force). The supplemental contact force also causes each of the tines 114 to respond as if the tine has greater resiliency than that of a tine unassisted by the spring arm 220. The supplemental contact force assists the return movement of the tine when the plug 18 is removed from the receptacle 134 and allowed to return from its deflected position to its original position before the plug was inserted into the receptacle. Because each spring arm 220 operates independently on the one of the tines 114 engaged by the spring arm 220, the supplemental contact force is provided to a particular tine even if one or more of the other tines are not engaged by a plug contact 20.

The supplemental contact force may improve the ability of the jack 100 to receive legacy plugs (not shown) having substantially different sizes and styles than a Category 6 plug (e.g., the plug 18), when inserted into the receptacle 134 by allowing an increased range of elastic deflection without undesirable permanent deformation of the tines 114. The independent operation of the spring arms 220 allows the use of legacy plugs of many configurations, size and number of plug contacts that cause some tines 114 to deflect by large amounts, such as when engaged by sidewalls or other non-contact portions of the plug, while other tines do not and still produce good electrical contact with the contacts of the legacy plug and without damage to the tines. Again, the increased resiliency is accomplished without the need to lengthen and/or thicken the tines to achieve it.

As explained above, the free end portions 238 of the spring arms 220 are configured to contact the second contact portions 160 of the tines 114. When the spring arms 220A to 220H are in contact with the tines 114A to 114H, respectively, the spring arms 220A to 220H are electrically coupled to the tines 114A to 114H, respectively.

As may be viewed in FIGS. 11 and 12, the spring arms 220A and 220B are electrically connected to the tines 114A and 114B, respectively, which are the tines of the second pair "P2." Turning to FIGS. 14 and 17, the spring arms 220A and 220B are substantially parallel to one another and this parallel arrangement and close positioning of the spring arm 220A and 220B relative to one another may help reduce crosstalk in the tines 114A and 114B.

Returning to FIGS. 11 and 12, the spring arm 220G and 220H are electrically connected to the tines 114G and 114H, respectively, which are the tines of the fourth pair "P4." Turning to FIGS. 14 and 17, the spring arms 220G and 220H are substantially parallel to one another and this parallel arrangement and close positioning of the spring arm 220G and 220H relative to one another may help reduce crosstalk in the tines 114G and 114H.

As may be viewed in FIGS. 11 and 12, the spring arms 220C and 220F are electrically connected to the tines 114C and 114F, respectively, which are the tines of the split third pair "P3." The spring arms 220D and 220E are electrically connected to the tines 114D and 114E, respectively, which are the tines of the first pair "P1." The tine 114F (of the split third pair "P3") is adjacent the tine 114E (of the first pair "P1"). This adjacency may allow the tine 114F to induce a signal (crosstalk) in the tine 114E via capacitive (and possibly inductive) coupling between the tines 114F and 114E. However, such a signal may be at least partially counteracted if the tine 114E were also adjacent the other tine (i.e., the tine 114C) of the split third pair "P3." This is accomplished by the spring arms 220C and 220E, which capacitively couple the tines 114C and 114E together. In other words, the first capacitor "C1" capacitively couples the tines 114C and 114E together to thereby at least partially counteract crosstalk between the tines 114F and 114E.

The tine 114F (of the split third pair "P3") is also adjacent the tines 114G and 114H (of the fourth pair "P4"). This adjacency may allow the tine 114F to induce a signal (crosstalk) in the fourth pair "P4" (i.e., a composite of the tines 114G and 114H) via capacitive (and possibly inductive) coupling between the tine 114F and the tines 114G and 114H of the fourth pair "P4." In other words, the tines 114G and 114H may behave as a single or composite conductor on which the tine 114F may (capacitively and/or inductively) impart a signal. However, such a signal could be at least partially counteracted if the fourth pair "P4" were also adjacent the other tine (i.e., the tine 114C) of the split third pair "P3." This is accomplished by the spring arms 220G, 220H, and 220C, which capacitively couple the tine 114C with the tines 114G and 114H of the fourth pair "P4." In other words, the fifth capacitor "C5" capacitively couples the tines 114G and 114C together and the sixth capacitor "C6" capacitively couples the tines 114H and 114C together to thereby at least partially counteract crosstalk between the tine 114F and the tines 114G and 114H of the fourth pair "P4."

The tine 114C (of the split third pair "P3") is adjacent the tine 114D (of the first pair "P1"). This adjacency may allow the tine 114C to induce a signal (crosstalk) in the tine 114D via capacitive (and possibly inductive) coupling between the tines 114C and 114D. However, such a signal could be at least partially counteracted if the tine 114D were also adjacent the other tine (i.e., the tine 114F) of the split third pair "P3." This is accomplished by the spring arms 220D and 220F, which capacitively couple the tines 114D and 114F. In other words, the second capacitor "C2" capacitively couples the tines 114D and 114F together to thereby at least partially counteract crosstalk between the tines 114C and 114D.

The tine 114C (of the split third pair "P3") is also adjacent the tines 114A and 114B (of the second pair "P2"). This adjacency may allow the tine 114C to induce a signal (crosstalk) in the second pair "P2" (i.e., a composite of the tines 114A and 114B) via capacitive (and possibly inductive) coupling between the tine 114C and the tines 114A and 114B of the second pair "P2." In other words, the tines 114A and 114B may behave as a single or composite conductor on which the tine 114C may (capacitively and/or inductively) impart a signal. However, such a signal could be at least partially counteracted if the second pair "P2" were also adjacent the other tine (i.e., the tine 114F) of the split third pair "P3." This is accomplished by the spring arms 220A, 220B, and 220F, which capacitively couple the tine 114F with the tines 114A and 114B of the second pair "P2." In other words, the third capacitor "C3" capacitively couples the tines 114A and 114F together and the fourth capacitor "C4" capacitively couples the tines 114B and 114F together to thereby at least partially counteract crosstalk between the tine 114C and the tines 114A and 114B of the second pair "P2."

In the manner described above, the first and second capacitors "C1" and "C2" provide crosstalk compensation for the tines 114C and 114F of the split third pair "P3" and the tines 114D and 114E of the first pair "P1" (positioned between the tines 114C and 114F of the split third pair "P3"). Thus, the flexible PCB 50 (see FIG. 3) used in the prior art jack 10 is not required inside the jack 100. Further, the third and fourth capacitors "C3" and "C4" provide crosstalk compensation for the tine (e.g., the tine 114C) of the split third pair "P3" adjacent the second pair "P2" and the tines 114A and 114B of the second pair "P2." And, the fifth and sixth capacitors "C5" and "C6" provide crosstalk compensation for the tine (e.g., the tine 114F) of the split third pair "P3" adjacent the fourth pair "P4" and the tines 114G and 114H of the fourth pair "P4."

The spring arm 220C also electrically connects the first capacitor "C1" with the fifth and sixth capacitors "C5" and "C6" to thereby couple the tines 114G and 114H of the fourth pair "P4" with the tine 114E of the first pair "P1." Further, the spring arm 220F also electrically connects the second capacitor "C2" with the third and fourth capacitors "C3" and "C4" to thereby couple the tines 114A and 114B of the second pair "P2" with the tine 114D of the first pair "P1."

Returning to FIG. 14, by way of a non-limiting example, the spring assembly 116 may be constructed by molding the non-conductive base 228 with the anchored portions 230 of the spring arms 220 placed inside a mold to thereby embed the anchored portions 230 inside the non-conductive base 228. In such an implementation, the spring arms 220 are non-removably coupled to the non-conductive base 228. However, in alternate embodiments, the non-conductive base 228 may include two or more parts that, when connected together (removably or permanently), form the non-conductive base 228. The anchored portions 230 may be placed inside or between two or more of these parts before they are connected together (removably or permanently). For example, the non-conductive base 228 may be constructed in a manner similar to that of the base 46 described in the Background Section and illustrated in FIG. 2, which has the first and second portions 46*a* and 46*b*, with the spring arms 220 sandwiched between the first and second portions 46*a* and 46*b*.

By way of a non-limiting example, the spring arms 220 may be constructed from phosphor bronze. However, this is not a requirement.

Optional Shield Enclosure

Referring to FIG. 5, the optional shield enclosure 130 may be configured to reduce crosstalk and/or noise transmitted between adjacent wire contacts 120. Such shield enclosures are known in the art and will not be described herein. An example of a suitable shield enclosure that may be used to implement the optional shield enclosure 130 is described in detail in U.S. Pat. No. 7,273,396, which is incorporated herein by reference in its entirety.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A spring assembly for use in a communications jack comprising a plurality of jack contacts comprising a first jack contact, a second jack contact, a third jack contact, a fourth jack contact, a fifth jack contact, and a sixth jack contact, the first jack contact and the second jack contact being configured to conduct a first differential signal, the third jack contact and the fourth jack contact being configured to conduct a second differential signal, the fifth jack contact and the sixth jack contact being configured to conduct a third differential signal, the jack being configured to receive a communications plug having a plug contact corresponding to each of the plurality of jack contacts, each of the plurality of jack contacts being electrically connected to a corresponding one of the plug contacts when the communications plug is received by the communications jack, the spring assembly comprising:

a corresponding conductive spring member for each of the plurality of jack contacts, each of the conductive spring members being electrically connected to a corresponding jack contact and configured to bias the corresponding jack contact against the corresponding plug contact to which the corresponding jack contact is electrically connected, the conductive spring member electrically connected to the first jack contact and the conductive spring member electrically connected to the second jack contact both being capacitively coupled to the fourth jack contact to reduce crosstalk between the third jack contact and the first and second jack contacts, and the conductive spring member electrically connected to the fifth jack contact and the conductive spring member electrically connected to the sixth jack contact both being capacitively coupled to the third jack contact to reduce crosstalk between the fourth jack contact and the fifth and sixth jack contacts.

2. The spring assembly of claim 1, wherein the conductive spring member electrically connected to the first jack contact is capacitively coupled to the fourth jack contact by a first parallel plate capacitor, the conductive spring member electrically connected to the second jack contact is capacitively coupled to the fourth jack contact by a second parallel plate capacitor, the conductive spring member electrically connected to the fifth jack contact is capacitively coupled to the third jack contact by a third parallel plate capacitor, and the conductive spring member electrically connected to the sixth jack contact is capacitively coupled to the third jack contact by a fourth parallel plate capacitor.

3. The spring assembly of claim 2, wherein the conductive spring member electrically connected to the first jack contact comprises a first capacitor plate, the conductive spring member electrically connected to the second jack contact comprises a second capacitor plate, the conductive spring member electrically connected to the fourth jack contact comprises a fourth capacitor plate, the first parallel plate capacitor comprises the first capacitor plate and the fourth capacitor plate, and the second parallel plate capacitor comprises the second capacitor plate and the fourth capacitor plate.

4. The spring assembly of claim 3, wherein the conductive spring member electrically connected to the fifth jack contact comprises a fifth capacitor plate, the conductive spring member electrically connected to the sixth jack contact comprises a sixth capacitor plate, the conductive spring member electrically connected to the third jack contact comprises a third capacitor plate, the third parallel plate capacitor comprises the fifth capacitor plate and the third capacitor plate, and the fourth parallel plate capacitor comprises the sixth capacitor plate and the third capacitor plate.

5. The spring assembly of claim 1 for use in the communications jack comprising the plurality of jack contacts further comprising a seventh jack contact and an eighth jack contact, wherein the conductive spring member electrically connected to the seventh jack contact is capacitively coupled to the fourth jack contact to reduce crosstalk between the seventh jack contact and the third jack contact, and the conductive spring member electrically connected to the eighth jack contact is capacitively coupled to the third jack contact to reduce crosstalk between the eighth jack contact and the fourth jack contact.

6. The spring assembly of claim 5, wherein the conductive spring member electrically connected to the first jack contact is capacitively coupled to the fourth jack contact by a first parallel plate capacitor, the conductive spring member electrically connected to the second jack contact is capacitively coupled to the fourth jack contact by a second parallel plate capacitor, the conductive spring member electrically connected to the fifth jack contact is capacitively coupled to the third jack contact by a third parallel plate capacitor, the conductive spring member electrically connected to the sixth jack contact is capacitively coupled to the third jack contact by a fourth parallel plate capacitor, the conductive spring member electrically connected to the seventh jack contact is capacitively coupled to the fourth jack contact by a fifth parallel plate capacitor, and the conductive spring member electrically connected to the eighth jack contact is capacitively coupled to the third jack contact by a sixth parallel plate capacitor.

7. The spring assembly of claim 1, further comprising:

a non-conductive base portion configured to position the conductive spring members relative to the jack contacts.

8. A spring assembly for use in a communications jack comprising a first jack contact, a second jack contact, a third jack contact, a fourth jack contact, a fifth jack contact, and a sixth jack contact, the first and second jack contacts forming a first differential signaling pair, the third and fourth jack contacts forming a second differential signaling pair, the fifth and sixth jack contacts forming a third differential signaling pair, the second differential signaling pair being positioned between the first and third differential signaling pairs with the first differential signaling pair being adjacent the third jack contact, the third differential signaling pair being adjacent the fourth jack contact, the spring assembly comprising;

a first conductive spring member comprising a first capacitor plate and a first jack contact portion, the first jack contact portion being configured to engage with the first jack contact and form an electrical connection therewith;

a second conductive spring member comprising a second capacitor plate and a second jack contact portion, the second jack contact portion being configured to engage with the second jack contact and form an electrical connection therewith;

a third conductive spring member comprising a third capacitor plate and a third jack contact portion, the third jack contact portion being configured to engage with the third jack contact and form an electrical connection therewith;

a fourth conductive spring member comprising a fourth capacitor plate and a fourth jack contact portion, the fourth jack contact portion being configured to engage with the fourth jack contact and form an electrical connection therewith;

a fifth conductive spring member comprising a fifth capacitor plate and a fifth jack contact portion, the fifth jack contact portion being configured to engage with the fifth jack contact and form an electrical connection therewith; and a sixth conductive spring member comprising a sixth capacitor plate and a sixth jack contact portion, the sixth jack contact portion being configured to engage with the sixth jack contact and form an electrical connection therewith;

the first capacitor plate being positioned relative to the fourth capacitor plate to form a first capacitor, the second capacitor plate being positioned relative to the fourth capacitor plate to form a second capacitor, the fifth capacitor plate being positioned relative to the third capacitor plate to form a third capacitor, and the sixth capacitor plate being positioned relative to the third capacitor plate to form a fourth capacitor.

9. The spring assembly of claim 8 for use in the communications jack further comprising a seventh jack contact and an eighth jack contact, the seventh and eighth jack contacts forming a fourth differential signaling pair positioned between the third and fourth jack contacts with the seventh jack contact adjacent the third jack contact and the eighth jack contact adjacent the fourth jack contact, the spring assembly further comprising:

a seventh conductive spring member comprising a seventh capacitor plate and a seventh jack contact portion, the seventh jack contact portion being configured to engage with the seventh jack contact and form an electrical connection therewith; and an eighth conductive spring member comprising an eighth capacitor plate and an eighth jack contact portion, the eighth jack contact portion being configured to engage with the eighth jack contact and form an electrical connection therewith;

wherein the third conductive spring member further comprises a ninth capacitor plate, the fourth conductive spring member further comprises a tenth capacitor plate, the seventh capacitor plate is positioned relative to the tenth capacitor plate to form a fifth capacitor, and the eighth capacitor plate is positioned relative to the ninth capacitor plate to form a sixth capacitor.

10. The spring assembly of claim 9, wherein the ninth capacitor plate of the third conductive spring member is positioned between the third capacitor plate and the third jack contact portion.

11. The spring assembly of claim 10, wherein the tenth capacitor plate of the fourth conductive spring member is positioned between the fourth capacitor plate and the fourth jack contact portion.

12. The spring assembly of claim 9, wherein the third conductive spring member comprises a first bent base portion positioned between the ninth capacitor plate and the third capacitor plate, the first bent base portion positioning the third capacitor plate farther away from the first, second, third, fourth, fifth, sixth, seventh, and eighth jack contacts than the ninth capacitor plate.

13. The spring assembly of claim 12, wherein the fourth conductive spring member comprises a second bent base portion positioned between the tenth capacitor plate and the fourth capacitor plate, the second bent base portion positioning the fourth capacitor plate farther away from the first, second, third, fourth, fifth, sixth, seventh, and eighth jack contacts than the tenth capacitor plate.

14. The spring assembly of claim 8 for use in a communications jack configured to receive a plug comprising a first plug contact, a second plug contact, a third plug contact, a fourth plug contact, a fifth plug contact, and a sixth plug contact, the first plug contact being configured to engage the first jack contact and when so engaged, deflect the first jack contact, the second plug contact being configured to engage the second jack contact and when so engaged, deflect the second jack contact, the third plug contact being configured to engage the third jack contact and when so engaged, deflect the third jack contact, the fourth plug contact being configured to engage the fourth jack contact and when so engaged, deflect the fourth jack contact, the fifth plug contact being configured to engage the fifth jack contact and when so engaged, deflect the fifth jack contact, and the sixth plug contact being configured to engage the sixth jack contact and when so engaged, deflect the sixth jack contact, wherein the first conductive spring member is further configured to apply a biasing force to the first jack contact to limit the deflection of the first jack contact caused by the first plug contact, the second conductive spring member is further configured to apply a biasing force to the second jack contact to limit the deflection of the second jack contact caused by the second plug contact, the third conductive spring member is further configured to apply a biasing force to the third jack contact to limit the deflection of the third jack contact caused by the third plug contact, the fourth conductive spring member is further configured to apply a biasing force to the fourth jack contact to limit the deflection of the fourth jack contact caused by the fourth plug contact, the fifth conductive spring member is further configured to apply a biasing force to the fifth jack contact to limit the deflection of the fifth jack contact caused by the fifth plug contact, and the sixth conductive spring member is further configured to apply a biasing force to the sixth jack contact to limit the deflection of the sixth jack contact caused by the sixth plug contact.

15. The spring assembly of claim 14 wherein the first, second, third, fourth, fifth, and sixth jack contacts each comprise a first side opposite a second side, the first, second, third, fourth, fifth, and sixth plug contacts engage the first sides of the first, second, third, fourth, fifth, and sixth jack contacts, respectively, and the first, second, third, fourth, fifth, and sixth conductive spring members engage the second sides of the first, second, third, fourth, fifth, and sixth jack contacts, respectively.

16. The spring assembly of claim 8 wherein the first, second, third, fourth, fifth, and sixth conductive spring members each comprise a bent portion configured to position the first, second, third, fourth, fifth, and sixth jack contact portions, respectively, for engagement with the first, second, third, fourth, fifth, and sixth jack contacts, respectively.

17. The spring assembly of claim 8 for use in a communications jack further comprising a body comprising guiderails configured to position the spring assembly relative to the first, second, third, fourth, fifth, and sixth jack contacts, the spring assembly further comprising:

a non-conductive base portion comprising guides configured to engage the guiderails and be positioned thereby, the first, second, third, fourth, fifth, and sixth conductive spring members being affixed to the non-conductive base portion and positionable by the non-conductive base portion relative to the first, second, third, fourth, fifth, and sixth jack contacts.

18. A spring assembly for use in a communications jack configured to receive a communications plug, the jack comprising a first jack contact, a second jack contact, a third jack contact, a fourth jack contact, a fifth jack contact, and a sixth jack contact, the first and second jack contacts comprising a first signaling pair, the third and fourth jack contacts comprising a second signaling pair, the fifth and sixth jack contacts comprising a third signaling pair, the second signaling pair being positioned between the first and third second signaling pairs with the first signaling pair adjacent the third jack contact and the third signaling pair adjacent the fourth jack contact, the first, second, third, fourth, fifth, and sixth jack contacts being deflected by the plug when the plug is received by the jack, the spring assembly comprising:

a first conductive spring member electrically connected to the first jack contact and configured to apply a biasing force to the first jack contact to lessen the deflection of the first jack contact by the plug;

a second conductive spring member electrically connected to the second jack contact and configured to apply a biasing force to the second jack contact to lessen the deflection of the second jack contact by the plug;

a third conductive spring member electrically connected to the third jack contact and configured to apply a biasing force to the third jack contact to lessen the deflection of the third jack contact by the plug;

a fourth conductive spring member electrically connected to the fourth jack contact and configured to apply a biasing force to the fourth jack contact to lessen the deflection of the fourth jack contact by the plug;

a fifth conductive spring member electrically connected to the fifth jack contact and configured to apply a biasing force to the fifth jack contact to lessen the deflection of the fifth jack contact by the plug;

a sixth conductive spring member electrically connected to the sixth jack contact and configured to apply a biasing force to the sixth jack contact to lessen the deflection of the sixth jack contact by the plug;

means for capacitively coupling the first conductive spring member with the fourth jack contact;

means for capacitively coupling the second conductive spring member with the fourth jack contact;

means for capacitively coupling the fifth conductive spring member with the third jack contact; and means for capacitively coupling the sixth conductive spring member with the third jack contact.

19. The spring assembly of claim 18 for use in the communications jack further comprising a seventh jack contact and an eighth jack contact, the seventh and eighth jack contacts comprising a fourth signaling pair, the fourth signaling pair being positioned between the third and fourth jack contacts with the seventh jack contact adjacent the third jack contact and the eighth jack contact adjacent the fourth jack contact, the spring assembly further comprising:

a seventh conductive spring member electrically connected to the seventh jack contact and configured to apply a biasing force to the seventh jack contact to lessen the deflection of the seventh jack contact by the plug;

an eighth conductive spring member electrically connected to the eighth jack contact and configured to apply a biasing force to the eighth jack contact to lessen the deflection of the eighth jack contact by the plug;

means for capacitively coupling the seventh conductive spring member with the fourth jack contact; and means for capacitively coupling the eighth conductive spring member with the third jack contact.

20. A communications jack for use with a communications plug comprising a plurality of plug contacts, the jack comprising:

a plurality of jack contacts comprising a first jack contact, a second jack contact, a third jack contact, a fourth jack contact, a fifth jack contact, and a sixth jack contact, the first and second jack contacts comprising a first signaling pair, the third and fourth jack contacts comprising a second signaling pair, the fifth and sixth jack contacts comprising a third signaling pair, the second signaling pair being positioned between the first and third second signaling pairs with the first signaling pair adjacent the third jack contact and the third signaling pair adjacent the fourth jack contact;

a receptacle configured to receive the communications plug, the plurality of jack contacts being positioned inside the receptacle to be contacted by the plurality of plug contacts of the communications plug when the communications plug is received inside the receptacle; and a spring assembly comprising a corresponding spring member for each of the plurality of jack contacts, each of the spring members being configured to bias the corresponding jack contact against a corresponding one of the plurality of plug contacts when the communications plug is received inside the receptacle, the spring member corresponding to the first jack contact being conductive, electrically connected to the first jack contact, and capacitively coupled to the fourth jack contact to reduce crosstalk between the first jack contact and the third jack contact, the spring member corresponding to the second jack contact being conductive, electrically connected to the second jack contact, and capacitively coupled to the fourth jack contact to reduce crosstalk between the second jack contact and the third jack contact, the spring member corresponding to the fifth jack contact being conductive, electrically connected to the fifth jack contact, and capacitively coupled to the third jack contact to reduce crosstalk between the fifth jack contact and the fourth jack contact, and the spring member corresponding to the sixth jack contact being conductive, electrically connected to the sixth jack contact, and capacitively coupled to the third jack contact to reduce crosstalk between the sixth jack contact and the fourth jack contact.

21. The communications jack of claim 20, wherein the plurality of jack contacts further comprises a seventh jack contact and an eighth jack contact, the seventh and eighth jack contacts comprise a fourth signaling pair, the fourth signaling pair is positioned between the third and fourth jack contacts with the seventh jack contact adjacent the third jack contact and the eighth jack contact adjacent the fourth jack contact, the spring member corresponding to the seventh jack contact is conductive, electrically connected to the seventh jack contact, and capacitively coupled to the fourth jack contact to reduce crosstalk between the seventh jack contact and the third jack contact, and the spring member corresponding to the eighth jack contact is conductive, electrically connected to the eighth jack contact, and capacitively coupled to the third jack contact to reduce crosstalk between the eighth jack contact and the fourth jack contact.

22. The communications jack of claim 20, further comprising:

a substrate, the plurality of jack contacts being mounted on the substrate and positioned thereby inside the receptacle to be contacted by the plurality of plug contacts of the communications plug, the spring assembly being mounted on the substrate positioned thereby adjacent to the plurality of jack contacts inside the receptacle.

23. The communications jack of claim 22, wherein the substrate comprises a circuit connected to each of the plurality of jack contacts mounted on the substrate, and the communications jack further comprises:

a wire contact connected to each of the circuits, each of the circuits connecting one of the jack contacts to one of the wire contacts, each of the wire contacts being connectable to an external wire;

a body portion having an opening in communication with the receptacle, the opening being configured for the communication plug to pass therethrough to enter the receptacle; and a terminal block couplable to the body portion with the substrate positioned therebetween, the receptacle being at least partially defined by the body housing and at least partially defined by the substrate, the plurality of jack contacts extending outwardly from the substrate into the receptacle, the spring members of the spring assembly extending outwardly from the substrate into the receptacle, and the wire contacts extending outwardly from the substrate into the terminal block.

24. A spring assembly for use in a communications jack comprising a plurality of jack contacts, the jack being configured to receive a communications plug having a plug contact corresponding to each of the plurality of jack contacts, each of the plurality of jack contacts being electrically connected to a corresponding one of the plug contacts when the communications plug is received by the communications jack, the spring assembly comprising:

a corresponding conductive spring member for each of the plurality of jack contacts, each of the conductive spring members being electrically connected to their corresponding jack contacts and biasing the corresponding jack contact against the corresponding plug contact, each of the conductive spring members comprising a capacitor plate, the capacitor plates being arranged to form at least one capacitor assembly capacitively coupling three of the conductive spring members together.

25. The spring assembly of claim 24, wherein the capacitor plates are arranged to form a first capacitor assembly and a second capacitor assembly, each of the first and second capacitor assemblies capacitively coupling three different conductive spring members together.

26. The spring assembly of claim 25, wherein the capacitor plates are further arranged to form a first parallel plate capacitor spaced apart from the first and second capacitor assemblies and a second parallel plate capacitor spaced apart from the first and second capacitor assemblies, each of the first and second parallel plate capacitors capacitively coupling two of the conductive spring members together.

27. The spring assembly of claim 26, wherein one of the conductive spring members capacitively coupled by the first capacitor assembly is also capacitively coupled by the first parallel plate capacitor and one of the conductive spring members capacitively coupled by the second capacitor assembly is also capacitively coupled by the second parallel plate capacitor.

28. A method comprising:

positioning a first conductive spring member against a first conductive jack contact of a communications jack to form an electrical connection therebetween, the first spring member being configured to bias the first jack contact against a first conductive plug contact of a communications plug when the first jack contact is adjacent the first plug contact;

positioning a second conductive spring member against a second conductive jack contact of the communications jack to form an electrical connection therebetween, the second spring member being configured to bias the second jack contact against a second conductive plug contact of the communications plug when the second jack contact is adjacent the second plug contact, the first jack contact and the second jack contact being configured to conduct a first differential signal;

positioning a third conductive spring member against a third conductive jack contact of the communications jack to form an electrical connection therebetween, the third spring member being configured to bias the third jack contact against a third conductive plug contact of the communications plug when the third jack contact is adjacent the third plug contact;

positioning a fourth conductive spring member against a fourth conductive jack contact of the communications jack to form an electrical connection therebetween, the fourth spring member being configured to bias the fourth jack contact against a fourth conductive plug contact of the communications plug when the fourth jack contact is adjacent the fourth plug contact, the third jack contact and the fourth jack contact being configured to conduct a second differential signal;

positioning a fifth conductive spring member against a fifth conductive jack contact of the communications jack to form an electrical connection therebetween, the fifth spring member being configured to bias the fifth jack contact against a fifth conductive plug contact of the communications plug when the fifth jack contact is adjacent the fifth plug contact;

positioning a sixth conductive spring member against a sixth conductive jack contact of the communications jack to form an electrical connection therebetween, the sixth spring member being configured to bias the sixth jack contact against a sixth conductive plug contact of the communications plug when the sixth jack contact is adjacent the sixth plug contact, the fifth jack contact and the sixth jack contact being configured to conduct a third differential signal;

capacitively coupling both the first conductive spring member and the second conductive spring member to the fourth conductive spring member to reduce crosstalk between the third jack contact and the first and second jack contacts; and capacitively coupling both the fifth conductive spring member and the sixth conductive spring member to the third conductive spring member to reduce crosstalk between the fourth jack contact and the fifth and sixth jack contacts.

29. The method of claim 28, wherein the first conductive spring member comprises a first capacitor plate, the second conductive spring member comprises a second capacitor plate, the fourth conductive spring member comprises a fourth capacitor plate, and capacitively coupling both the first conductive spring member and the second conductive spring member to the fourth conductive spring member comprises positioning the first capacitor plate relative to the fourth capacitor plate to form a first parallel plate capacitor, and positioning the second capacitor plate relative to the fourth capacitor plate to form a second parallel plate capacitor.

30. The method of claim 29, wherein the fifth conductive spring comprises a fifth capacitor plate, the sixth conductive spring member comprises a sixth capacitor plate, the third conductive spring member comprises a third capacitor plate, and capacitively coupling both the fifth conductive spring member and the sixth conductive spring member to the third conductive spring member comprises positioning the fifth capacitor plate relative to the third capacitor plate to form a third parallel plate capacitor, and positioning the sixth capacitor plate relative to the third capacitor plate to form a fourth parallel plate capacitor.

31. The method of claim 30, further comprising:

positioning a seventh conductive spring member against a seventh conductive jack contact of the communications jack to form an electrical connection therebetween, the seventh spring member being configured to bias the seventh jack contact against a seventh conductive plug contact of the communications plug when the seventh jack contact is adjacent the seventh plug contact;

positioning an eighth conductive spring member against an eighth conductive jack contact of the communications jack to form an electrical connection therebetween, the eighth spring member being configured to bias the eighth jack contact against an eighth conductive plug contact of the communications plug when the eighth jack contact is adjacent the eighth plug contact;

capacitively coupling the seventh conductive spring member to the fourth conductive spring member to reduce crosstalk between the seventh jack contact and the third jack contact, and capacitively coupling the eighth conductive spring member to the third conductive spring member to reduce crosstalk between the eighth jack contact and the fourth jack contact.

32. The method of claim 31, wherein the seventh conductive spring comprises a seventh capacitor plate, the eighth conductive spring member comprises an eighth capacitor plate, the third conductive spring member comprises a ninth capacitor plate, the fourth conductive spring member comprises a tenth capacitor plate, capacitively coupling the seventh conductive spring member to the fourth conductive spring member comprises positioning the seventh capacitor plate relative to the tenth capacitor plate to form a fifth parallel plate capacitor, and capacitively coupling the eighth conductive spring member to the third conductive spring member comprises positioning the eighth capacitor plate relative to the ninth capacitor plate to form a sixth parallel plate capacitor.

33. The method of claim 28, further comprising:

positioning a seventh conductive spring member against a seventh conductive jack contact of the communications jack to form an electrical connection therebetween, the seventh spring member being configured to bias the seventh jack contact against a seventh conductive plug contact of the communications plug when the seventh jack contact is adjacent the seventh plug contact;

positioning an eighth conductive spring member against an eighth conductive jack contact of the communications jack to form an electrical connection therebetween, the eighth spring member being configured to bias the eighth jack contact against an eighth conductive plug contact of the communications plug when the eighth jack contact is adjacent the eighth plug contact;

capacitively coupling the seventh conductive spring member to the fourth conductive spring member to reduce crosstalk between the seventh jack contact and the third jack contact, and capacitively coupling the eighth conductive spring member to the third conductive spring member to reduce crosstalk between the eighth jack contact and the fourth jack contact.

* * * * *